US006934623B2

(12) United States Patent
Nakamura et al.

(10) Patent No.: US 6,934,623 B2
(45) Date of Patent: Aug. 23, 2005

(54) ENGINE CONTROL DEVICE

(75) Inventors: Michihisa Nakamura, Shizuoka (JP); Yuichiro Sawada, Shizuoka (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/493,765

(22) PCT Filed: Oct. 22, 2002

(86) PCT No.: PCT/JP02/10949

§ 371 (c)(1),
(2), (4) Date: Apr. 26, 2004

(87) PCT Pub. No.: WO03/038263

PCT Pub. Date: May 8, 2003

(65) Prior Publication Data

US 2005/0021220 A1 Jan. 27, 2005

(30) Foreign Application Priority Data

Oct. 29, 2001 (JP) ..... 2001-331530

(51) Int. Cl.[7] ..... F02D 41/10; F02D 41/26
(52) U.S. Cl. ..... 701/115; 123/492
(58) Field of Search ..... 701/115, 110, 701/102, 101; 123/491, 492, 494

(56) References Cited

U.S. PATENT DOCUMENTS 6,208,930 B1 3/2001 Uematsu ..... 701/110

FOREIGN PATENT DOCUMENTS

| | | | | |
|---|---|---|---|---|
| JP | 56-113129 | | 9/1981 | |
| JP | 01-182555 | | 7/1989 | |
| JP | 05-125987 | | 5/1993 | |
| JP | 04-072436 | | 3/1995 | |
| JP | 10-227252 | | 8/1998 | |
| JP | 2002-147269 A | * | 5/2002 | ..... F02D/41/10 |
| JP | 2002-242749 | | 8/2002 | |
| JP | 2002-317684 | | 10/2002 | |

* cited by examiner

*Primary Examiner*—Hieu T. Vo
(74) *Attorney, Agent, or Firm*—Hogan & Hartson LLP

(57) ABSTRACT

An accelerated state is detected as soon as possible at the engine start at which a crank pulse alone is insufficient to identify the stroke, and erroneous detection of the accelerated state is prevented. In a period from cranking start to stroke detection, data on suction air pressure is stored for each crank pulse in a virtual address, and during stroke detection, when the virtual address does not coincide with the normal address corresponding to the stroke, the data on the suction air pressure stored in the virtual address is transferred to the normal address, and thereafter the data on the suction air pressure is stored in the normal address, thereby making it possible to detect the accelerated state by making comparison, immediately after the stroke detection, with the suction air pressure prevailing one cycle before. Further, detection of an accelerated state is inhibited when the engine rpm variation is high wherein the suction air pressure increase state during the closure of the suction air valve does not become stable and also when the engine load is high.

4 Claims, 16 Drawing Sheets

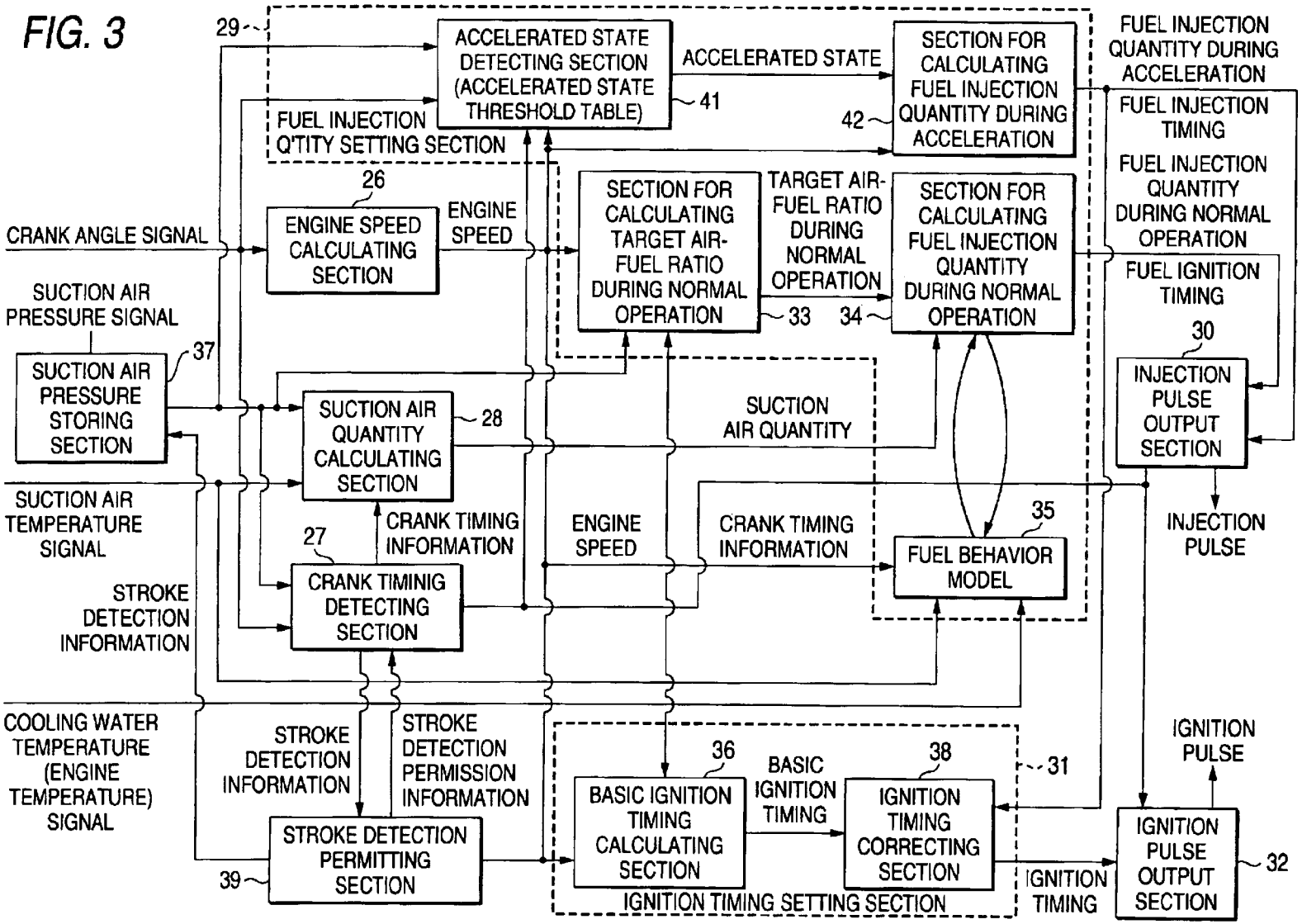
FIG. 3
FUEL INJECTION QUANTITY DURING ACCELERATION
FUEL INJECTION TIMING
FUEL INJECTION QUANTITY DURING NORMAL OPERATION
FUEL IGNITION TIMING
30
INJECTION PULSE OUTPUT SECTION
INJECTION PULSE
IGNITION PULSE
32
IGNITION PULSE OUTPUT SECTION
SECTION FOR CALCULATING FUEL INJECTION QUANTITY DURING ACCELERATION
42
SECTION FOR CALCULATING FUEL INJECTION QUANTITY DURING NORMAL OPERATION
34
35
FUEL BEHAVIOR MODEL
31
IGNITION TIMING
38
IGNITION TIMING CORRECTING SECTION
ACCELERATED STATE
TARGET AIR-FUEL RATIO DURING NORMAL OPERATION
33
SUCTION AIR QUANTITY
CRANK TIMING INFORMATION
BASIC IGNITION TIMING
36
BASIC IGNITION TIMING CALCULATING SECTION
IGNITION TIMING SETTING SECTION
41
ACCELERATED STATE DETECTING SECTION (ACCELERATED STATE THRESHOLD TABLE)
SECTION FOR CALCULATING TARGET AIR-FUEL RATIO DURING NORMAL OPERATION
ENGINE SPEED
ENGINE SPEED
28
CRANK TIMING INFORMATION
STROKE DETECTION PERMISSION INFORMATION
FUEL INJECTION QTITY SETTING SECTION
26
ENGINE SPEED CALCULATING SECTION
SUCTION AIR QUANTITY CALCULATING SECTION
27
CRANK TIMINIG DETECTING SECTION
STROKE DETECTION INFORMATION
STROKE DETECTION PERMITTING SECTION
29
39
37
CRANK ANGLE SIGNAL
SUCTION AIR PRESSURE SIGNAL
SUCTION AIR PRESSURE STORING SECTION
SUCTION AIR TEMPERATURE SIGNAL
STROKE DETECTION INFORMATION
COOLING WATER TEMPERATURE (ENGINE TEMPERATURE) SIGNAL

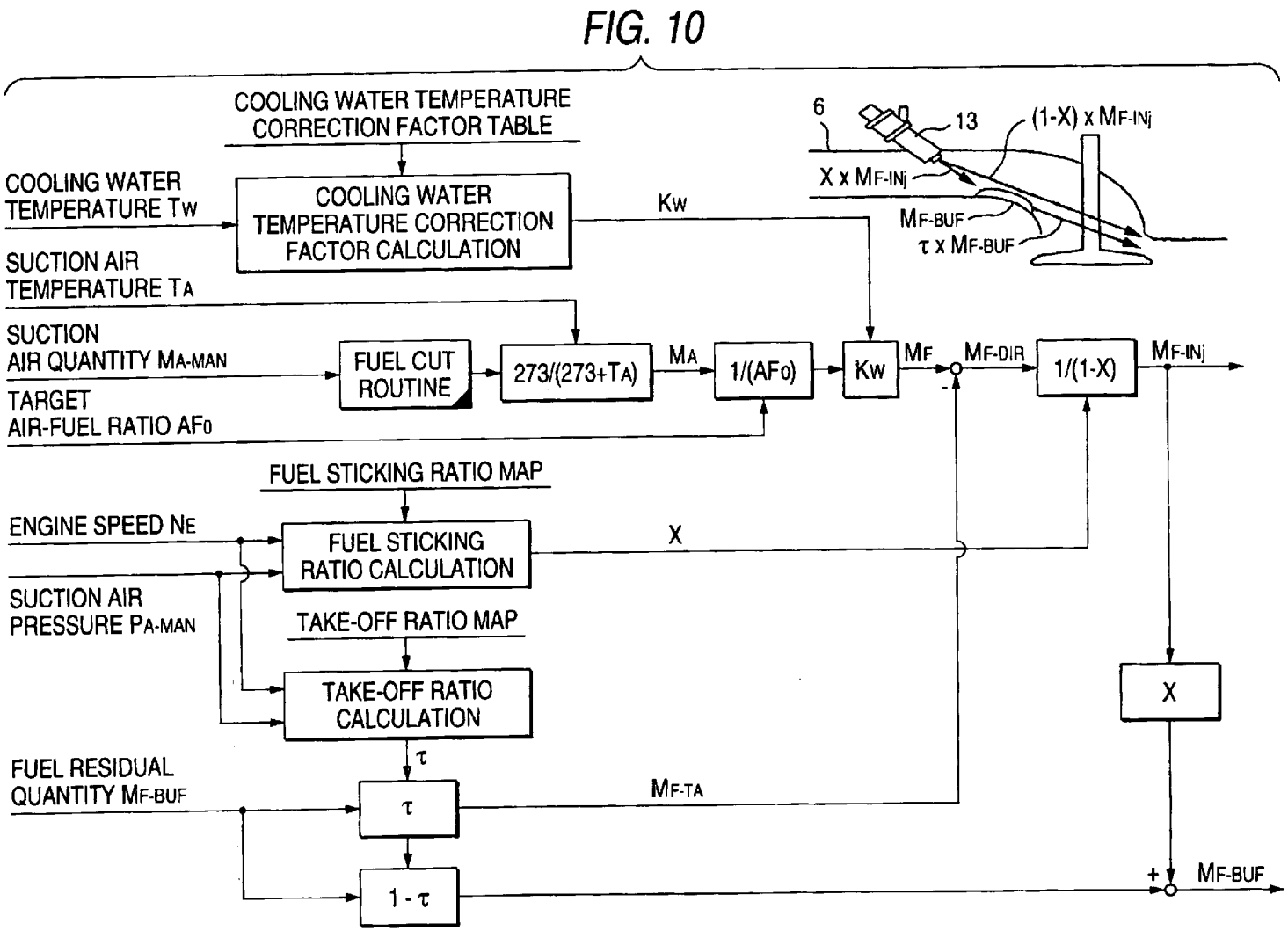
FIG. 10
COOLING WATER TEMPERATURE CORRECTION FACTOR TABLE
COOLING WATER TEMPERATURE CORRECTION FACTOR CALCULATION
COOLING WATER TEMPERATURE TW
SUCTION AIR TEMPERATURE TA
SUCTION AIR QUANTITY MA-MAN
TARGET AIR-FUEL RATIO AF0
FUEL CUT ROUTINE
273/(273+TA)
MA
1/(AF0)
KW
MF
MF-DIR
1/(1-X)
MF-INJ
X
MF-BUF
FUEL STICKING RATIO MAP
FUEL STICKING RATIO CALCULATION
ENGINE SPEED NE
TAKE-OFF RATIO MAP
TAKE-OFF RATIO CALCULATION
SUCTION AIR PRESSURE PA-MAN
τ
1 - τ
FUEL RESIDUAL QUANTITY MF-BUF
MF-TA
6
13
X x MF-INJ
(1-X) x MF-INJ
MF-BUF
τ x MF-BUF

ENGINE CONTROL DEVICE

TECHNICAL FIELD

The present invention relates to an engine controller for controlling an engine, and more particularly to the control of an engine having the fuel injection equipment for injecting the fuel.

BACKGROUND ART

In recent years, along with the development of the fuel injection equipment called an injector, the fuel injection timing and the fuel injection quantity or the air-fuel ratio are easily controlled to effectuate the higher output, lower fuel consumption, and cleaner exhaust gas. Particularly at the fuel injection timing, it is common to strictly detect the state of a suction air valve, typically the phase state of a camshaft to inject the fuel in accordance with the phase state. However, a so-called cam sensor for detecting the phase state of the camshaft is expensive, and not often employed especially in the two-wheeled vehicle because the cylinder head is large in size. Therefore, in JP-A-10-227252, an engine controller is offered in which the phase state of a crankshaft and the suction air pressure are detected to find the stroke state of a cylinder. Accordingly, the stroke state is found without detecting the phase of the camshaft, employing this conventional technique, whereby it is possible to control the fuel injection timing in accordance with the stroke state.

By the way, to control the fuel injection quantity injected from the fuel injection equipment as previously described, a target air-fuel ratio is set in accordance with the engine speed and the throttle opening, and an actual suction air quantity is detected and multiplied by an inverse of the target air-fuel ratio to calculate a target fuel injection quantity.

To detect the suction air quantity, a hot wire air flow sensor and a Karman vortex sensor are typically employed to measure the mass flow and the volumetric flow, respectively, although a volumetric body (serge tank) for suppressing the pressure pulsation is needed, or mounted at a position where counter-flowing air does not enter to remove the error factors due to counter-flowing air. However, most engines for two-wheeled vehicles are based on a so-called individual-suction system for each cylinder, or a single cylinder engine, whereby those requirements are often not fully satisfied, and the suction air quantity is not accurately detected, employing these flow sensors.

Also, detection of the suction air quantity occurs at the final stage of the suction stroke, or the early stage of the compression stroke, when the fuel is already injected, whereby the air-fuel ratio control with the suction air quantity is only made at the next cycle. Even though the driver accelerates the vehicle by opening the throttle in a period up to the next cycle, a torque or output corresponding to acceleration may not be obtained, because the air-fuel ratio is adjusted at the previous target air-fuel ratio, whereby the driver has a feeling of disorder not to attain full acceleration. To solve this problem, a throttle valve sensor or a throttle position sensor for detecting a state of throttle may be employed to perceive a driver's will of acceleration, but especially in the case of the two-wheeled vehicle, these sensors, which are large in size and expensive, are not employed, whereby the problem is not solved in the current situation.

Thus, the suction air pressure within a suction pipe of the engine is detected. A comparison is made between the suction air pressure at the same stroke in the same phase of the crankshaft at the previous cycle, namely, one cycle before, or before two rotations of the crankshaft in the four-stroke cycle engine, and the present suction air pressure, in which if its difference value is greater than or equal to a predetermined value, an accelerated state is decided, and the fuel injection quantity corresponding to the accelerated state is set up. More specifically, if the accelerated state is detected from the suction air pressure, the fuel is promptly injected. Further, the fuel injection quantity during acceleration may be set up in consideration of an operating condition of the engine. This is derived from the fact that the suction air pressure at the suction stroke or the exhaust stroke before it accords with the opening of the throttle valve. However, it is found that it may be difficult to detect the accelerated state from the suction air pressure, depending on the operating condition of the engine.

Also, to detect the phase state of the crankshaft as previously described, the crankshaft itself or a member rotating synchronously with the crankshaft is formed with the teeth around its outer circumference, whereby an approaching tooth is sensed by a magnetic sensor to send out a pulse signal, which is detected as a crank pulse. The crank pulses detected in this way are numbered to detect the phase state of the crankshaft. For this numbering, the teeth are often provided at irregular intervals. That is, the detected crank pulses are marked with the feature. And the phase of the crankshaft is detected from the featured crank pulse, and the stroke is detected by comparing the suction air pressures in the same phase during two rotations of the crankshaft, whereby the injection timing and the ignition timing are controlled in accordance with this stroke and the phase of the crankshaft.

However, at the start of the engine, for example, the stroke is not detected unless the crankshaft is rotated at least twice. Particularly at the early time of starting the engine in the two-wheeled vehicle with small displacement and one cylinder, the rotating state of the crankshaft is not stable and the state of the crank pulse is not stable, in which it is difficult to detect the stroke. To detect the accelerated state as previously described, the suction air pressure one cycle before is needed. Moreover, it is required that the suction air pressure occurs in the suction stroke or the exhaust stroke before it. Accordingly, if the suction air pressure starts to be stored after the stroke detection, and the accelerated state is detected employing the stored suction air pressure alone, as previously described, the suction air pressure before the stroke detection is not employed, causing a problem that detection of the accelerated state is delayed correspondingly.

The present invention is achieved to solve the above-mentioned problems, and it is an object of the invention to provide an engine controller for inhibiting the detection of the accelerated state when it is difficult to detect the accelerated state from the suction air pressure, and quickening the detection of the accelerated state at the start of the engine.

DISCLOSURE OF INVENTION

In order to achieve the above object, according to claim 1 of the present invention, there is provided an engine controller characterized by comprising phase detecting means for detecting the phase of a crankshaft in a four-stroke cycle engine, suction air pressure detecting means for detecting a suction air pressure within a suction air passage of the engine, accelerated state detecting means for detecting an accelerated state when a difference value between a previous suction air pressure and a present suction air pressure detected at the same stroke in the same crankshaft phase by the suction air pressure detecting means is greater than or equal to a predetermined value, acceleration fuel injection quantity setting means for setting an acceleration fuel injection quantity injected from the fuel injection equipment when the accelerated state detecting means detects the accelerated state, engine operating condition detecting means for detecting an operating condition of the engine, and accelerated state detection inhibiting means for inhibiting the accelerated state detecting means from detecting the accelerated state depending on the operating condition of the engine detected by the engine operating condition detecting means.

Also, according to claim 2 of the invention, the engine controller according to claim 1 is characterized by further comprising engine load detecting means for detecting an engine load as the engine operating condition detecting means, in which the accelerated state detection inhibiting means inhibits the detection of the accelerated state when the engine load detected by the engine load detecting means is high.

Also, according to claim 3 of the invention, the engine controller according to claim 1 or 2 is characterized by further comprising engine speed detecting means for detecting an engine speed as the engine operating condition detecting means, in which the accelerated state detection inhibiting means inhibits the detection of the accelerated state when there is a great variation in the engine speed detected by the engine speed detecting means.

Also, according to claim 4 of the invention, there is provided an engine controller characterized by comprising crankshaft phase detecting means for detecting the phase of a crankshaft, suction air pressure detecting means for detecting a suction air pressure within a suction air passage of an engine, stroke detecting means for detecting an engine stroke on the basis of the phase of the crankshaft detected by the crankshaft phase detecting means and the suction air pressure detected by the suction air pressure detecting means, engine control means for controlling an operating condition of the engine on the basis of the engine stroke detected by the stroke detecting means, and suction air pressure storing means for storing the suction air pressure detected by the suction air pressure detecting means in a memory area corresponding to the phase of the crankshaft detected by the crankshaft phase detecting means, wherein the suction air pressure storing means stores the suction air pressure detected by the suction air pressure detecting means in a virtual memory area corresponding to the phase of the crankshaft detected by the crankshaft phase detecting means, till the engine stroke is detected by the stroke detecting means, and stores the suction air pressure detected by the suction air pressure detecting means in a normal memory area corresponding to the phase of the crankshaft detected by the crankshaft phase detecting means, after the engine stroke is detected by the stroke detecting means, whereby when the engine stroke is detected by the stroke detecting means, if the virtual memory area corresponding to the phase of the crankshaft does not coincide with the normal memory area, the suction air pressure stored in the virtual memory area is transferred to the normal memory area.

BRIEF DESCRIPTION OF DRAWINGS

FIG. 3 is a block diagram showing an engine controller according to one embodiment of the invention.

FIG. 10 is a block diagram of a fuel injection quantity calculating section with a fuel behavior model.

BEST MODE FOR CARRYING OUT THE INVENTION

The preferred embodiments of the present invention will be described below.

Figure 1:
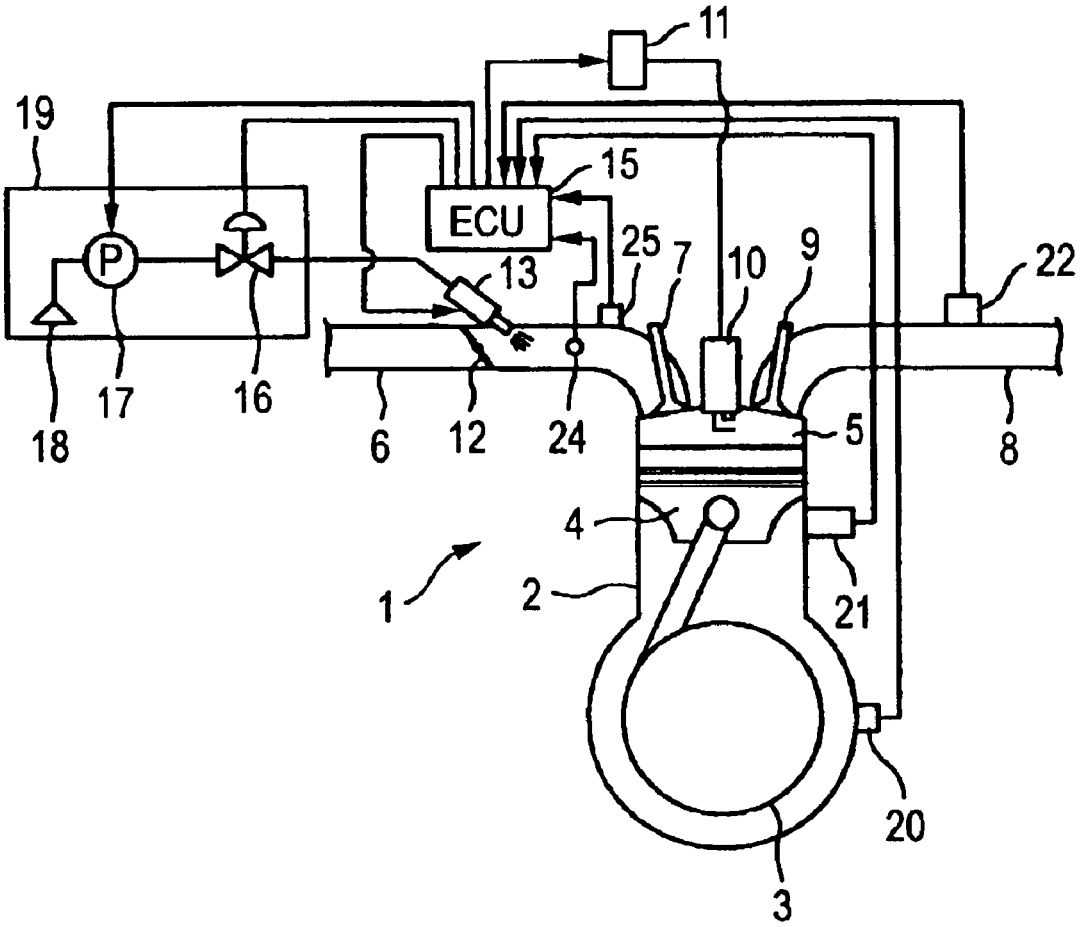
FIG. 1 is a schematic constitution view of a motor cycle engine with its-control device.

FIG. 1 is a schematic constitution view exemplifying a motor cycle engine with its control device. This engine 1 is a single cylinder four-stroke cycle engine having a relatively small displacement, and comprises a cylinder body 2, a crankshaft 3, a piston 4, a combustion chamber 5, a suction pipe (suction air passage) 6, a suction air valve 7, an exhaust pipe 8, an exhaust valve 9, an ignition plug 10, and an ignition coil 11. Also, a throttle valve 12 that is opened or closed in accordance with an accelerator opening is provided within the suction pipe 6, and an injector 13 as the fuel injection equipment is provided on the suction pipe 6 on the downstream side of this throttle valve 12. This injector 13 is connected to a filter 18, a fuel pump 17 and a pressure control valve 16, which are disposed within a fuel tank 19.

The operating condition of the engine 1 is controlled by an engine control unit 15. As means for detecting a control input of the engine control unit 15, namely, the operating condition of the engine 1, there are provided a crank angle sensor 20 for sensing a rotational angle or phase of the crankshaft 3, a cooling water temperature sensor 21 for sensing the temperature of the cylinder body 2 or the cooling water temperature, namely the temperature of the engine main body, an exhaust air-fuel ratio sensor 22 for sensing the air-fuel ratio within the exhaust pipe 8, a suction air pressure sensor 24 for sensing the suction air pressure within the suction pipe 6, and a suction air temperature sensor 25 for sensing the temperature within the suction pipe, or the suction air temperature. And the engine control unit 15 inputs a sensing signal from those sensors, and outputs a control signal to the fuel pump 17, the pressure control valve 16, the injector 13 and the ignition coil 11.

Figure 2A:
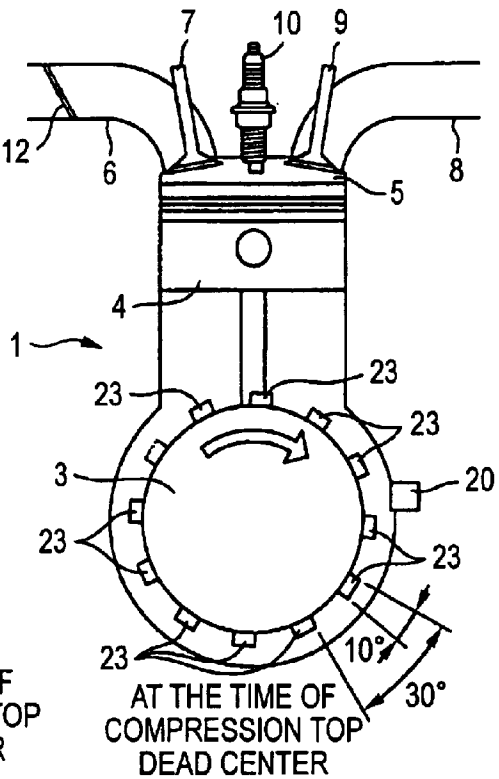
FIG. 2 is an explanatory view for explaining a principle for sending out a crank pulse in the engine of FIG. 1.

Herein, the principle of a crank angle signal output from the crank angle sensor 20 will be described below. In this embodiment, plurality of teeth 23 are protruded at almost regular intervals around the outer circumference of the crankshaft 3, as shown in FIG. 2*a*, whereby an approaching tooth is sensed by the crank angle sensor 20 such as a magnetic sensor to send out a pulse signal through the appropriate electrical processing. A pitch of the teeth 23 in the circumferential direction is 30° in the phase (rotational angle) of the crankshaft 3, and the width of the teeth 23 in the circumferential direction is 10° in the phase (rotational angle) of the crankshaft 3. However, there is only one position having another pitch, which is double the pitch of other teeth 23. At this position, the tooth is not specifically provided, although it should be essentially provided, as indicated by the two-dot chain line in FIG. 2*a*. This portion corresponds to an irregular interval. In the following, this portion is referred to as a missing tooth portion.

Figure 2B:
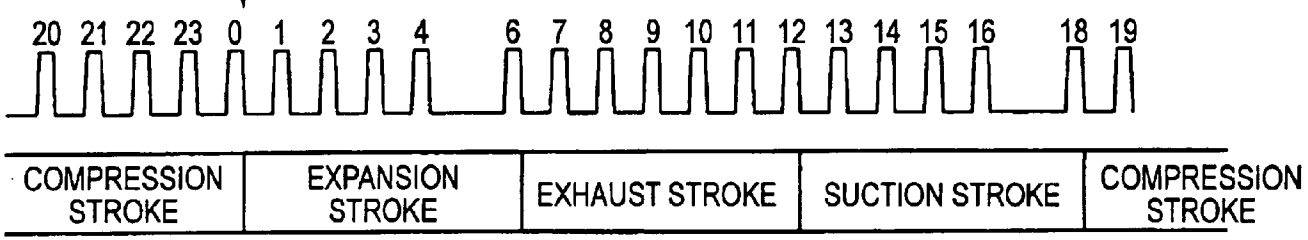

Accordingly, when the crankshaft is rotated at constant speed, a pulse signal train of the teeth 23 appears as shown in FIG. 2*b*. Though FIG. 2*a* shows a state at the compression top dead center (the exhaust top dead center is the same in the form), a pulse signal immediately before this compression top dead center is indicated by "0". The next pulse signal is numbered as "1", then numbered as "2", . . . , and is sequentially numbered up to "4". Since the tooth 23 corresponding to the pulse signal "4" is next to the missing tooth portion, considering as if the tooth are present, one tooth is additionally counted, so that the pulse signal for the next tooth 23 is number as "6". Repeating this operation, the missing tooth portion is next to the pulse signal "16" this time, whereby one tooth is additionally counted in the same way as previously, so that the pulse signal for the next tooth 23 is number as "18". If the crankshaft 3 is rotated twice, all the cycle of four strokes is completed. After the pulse signal 23" is numbered, the pulse signal of the next tooth 23 is numbered "0" again. In principle, the compression top dead center occurs immediately after the pulse signal for the tooth 23 numbered as "0". In this way, the detected pulse signal train, or the simple pulse signal is defined as the crank pulse. And if the stroke detection is made on the basis of this crank pulse in the manner as will be described later, the crank timing is detected. The tooth 23 may be provided around the outer circumference of the member being rotated synchronously with the crankshaft 3 to attain the exactly same effect.

On the other hand, the engine control unit 15 is composed of a microcomputer, not shown. FIG. 3 is a block diagram showing an embodiment of an engine control operation process that is performed by the microcomputer within the engine control unit 15. In this operation process, there are provided an engine speed calculating section 26 for calculating the engine speed from the crank angle signal, a crank timing detecting section 27 for detecting the crank timing information, namely the stroke state, from the crank angle signal and the suction air pressure signal, a stroke detecting permitting section 39 for reading the engine speed calculated by the engine speed calculating section 26 and outputting the stroke detection permission information to the crank timing detecting section 27, as well as retrieving and outputting the stroke detection information by the crank timing detecting section 27, a suction air pressure storing section 37 for reading the stroke detection information output from the stroke detection permitting section 39 and storing the suction air pressure of the suction air pressure signal, a suction air quantity calculating section 28 for calculating the suction air quantity from the suction air temperature signal and the suction pipe pressure signal by reading the crank timing information detected by the crank timing detecting section 27, a fuel injection quantity setting section 29 for calculating and setting the fuel injection quantity and the fuel injection timing by setting the target air-fuel ratio and detecting the accelerated state on the basis of the engine speed calculated by the engine speed calculating section 26 and the suction air quantity detected by the suction air quantity calculating section 28, an injection pulse output section 30 for reading the crank timing information detected by the crank timing detecting section 27 and outputting to the injector 13 an injection pulse according to the fuel injection quantity and the fuel injection timing set by the fuel injection quantity setting section 29, an ignition timing setting section 31 for reading the crank timing information detected by the crank timing detecting section 27 and setting the ignition timing on the basis of the engine speed calculated by the engine speed calculating section 26 and the fuel injection quantity set by the fuel injection quantity setting section 29, an ignition pulse output section 32 for reading the crank timing information detected by the crank timing detecting section 27 and outputting to the ignition coil 11 an ignition pulse according to the ignition timing set by the ignition timing setting section 31.

The engine speed calculating section 26 calculates a rotation rate of the crankshaft that is an output shaft of the engine as the engine speed from a temporal rate of change of the crank angle signal. More specifically, it calculates an instantaneous value of the engine speed that is the phase between adjacent teeth 23 divided by a required time for detecting the corresponding crank pulse and an average value of the engine speed that is the moving average value.

Figure 4:
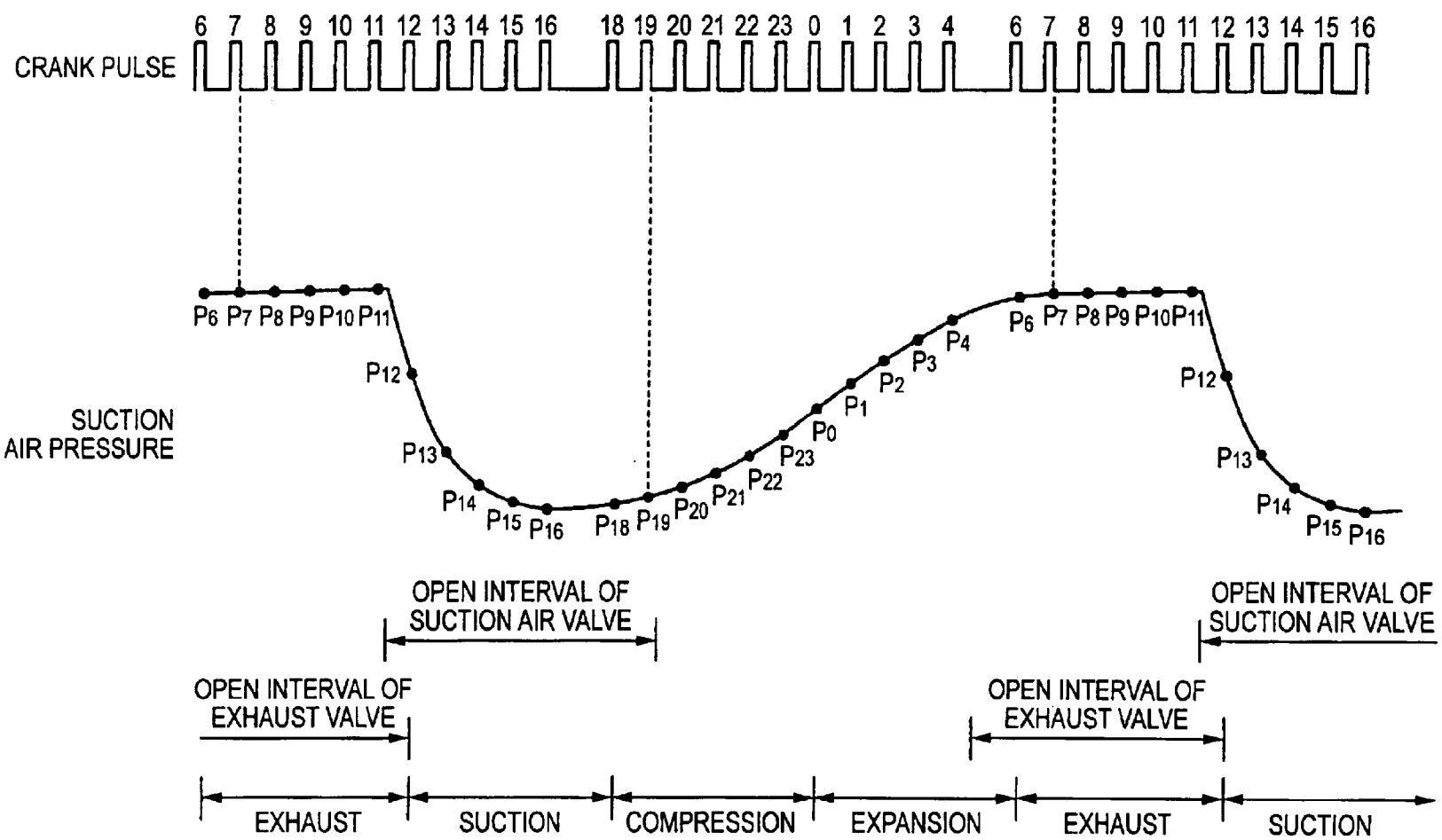
FIG. 4 is an explanatory view for explaining the detection of the stroke state from the phase of the crank pulse and the suction air pressure.

The crank timing detecting section 27 has the same constitution as a stroke discriminating device described in JP-A-10-227252, and thereby outputs the crank timing information by detecting the stroke state for each cylinder as shown in FIG. 4. That is, in the four-stroke cycle engine, since the crankshaft and the camshaft continue to be rotated with a predetermined phase difference at all time, the crank pulse "9" or "21" at the fourth position from the missing tooth portion is in either the exhaust stroke or compression stroke, when the crank pulse is read as shown in FIG. 4. As well known, the exhaust valve becomes closed in the exhaust stroke, while the suction air valve is kept closed, so that the suction air pressure is high. At the early stage of the compression stroke, the suction air valve is still open, so that the suction air pressure is low, or even though the suction air valve is closed, the suction air pressure becomes low in the preceding suction stroke. Accordingly, the crank pulse "21" when the suction air pressure is low is in the compression stroke, in which the compression top dead center occurs immediately after the crank pulse "0" is obtained. In this manner, if any stroke state is detected, the period of this stroke is interpolated by the rotation speed of the crankshaft, whereby the present stroke state is detected more minutely.

Figure 5:
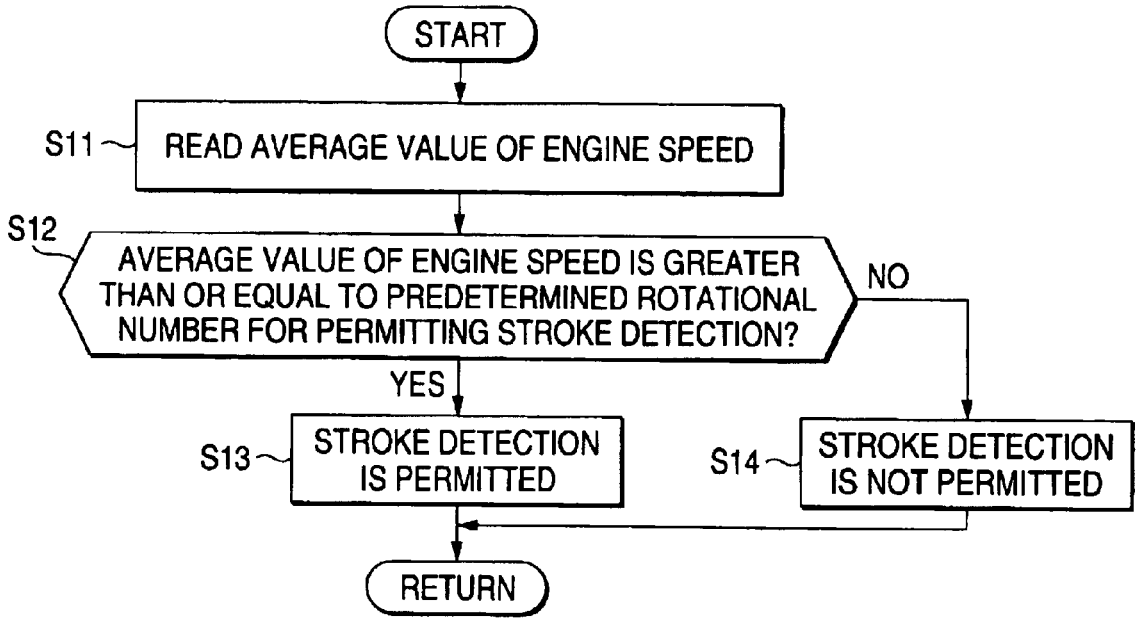
FIG. 5 is a flowchart showing an operation process that is performed in a stroke detection permitting section of FIG. 3.

The stroke detection permitting section 39 outputs the stroke detection permission information for the crank timing detecting section 27 in accordance with an operation process as shown in FIG. 5. As previously described, to detect the stroke from the crank pulse, at least two rotations of the crankshaft are required. Meanwhile, it is necessary that the crank pulse including the missing tooth portion is stable. However, in the single cylinder engine having relatively small displacement as in this embodiment, at the so-called cranking time when the engine is started, the rotating state of the engine is not stable. Thus, the rotating state of the engine is determined through the operation process of FIG. 5 to permit the stroke detection.

The operation process of FIG. 5 is executed by a timer interrupt at every sampling time ΔT, equivalently to the operation process of FIG. 3. In this flowchart, though the steps for communication are not particularly provided, the information acquired through the operation process is stored and updated in the storage device at anytime, and the information or program necessary for the operation process is read from the storage device at any time.

In this operation process, first of all, at step S11, the average value of engine speed calculated by the engine speed calculating section 26 is read in.

At step S12, a determination is made whether or not the average value of engine speed read at step S11 is greater than or equal to a preset engine speed for stroke detection permission that is beyond the corresponding engine speed at the early time. If the average value of engine speed is greater than or equal to the preset engine speed for stroke detection permission, the procedure goes to step S13. If not, the procedure transfers to step S14.

At step S13, the information as to stroke detection permission is output, and then the procedure returns to a main program.

Also, at step S14, the information indicating that the stroke detection is not permitted is output, and the procedure returns to the main program.

Through this operation process, the stroke detection is permitted if the average value of engine speed is at least greater than or equal to the preset engine speed for stroke detection permission that is beyond the corresponding engine speed at the early time, whereby the crank pulse is stable and the correct stroke detection is allowed.

Figure 6:
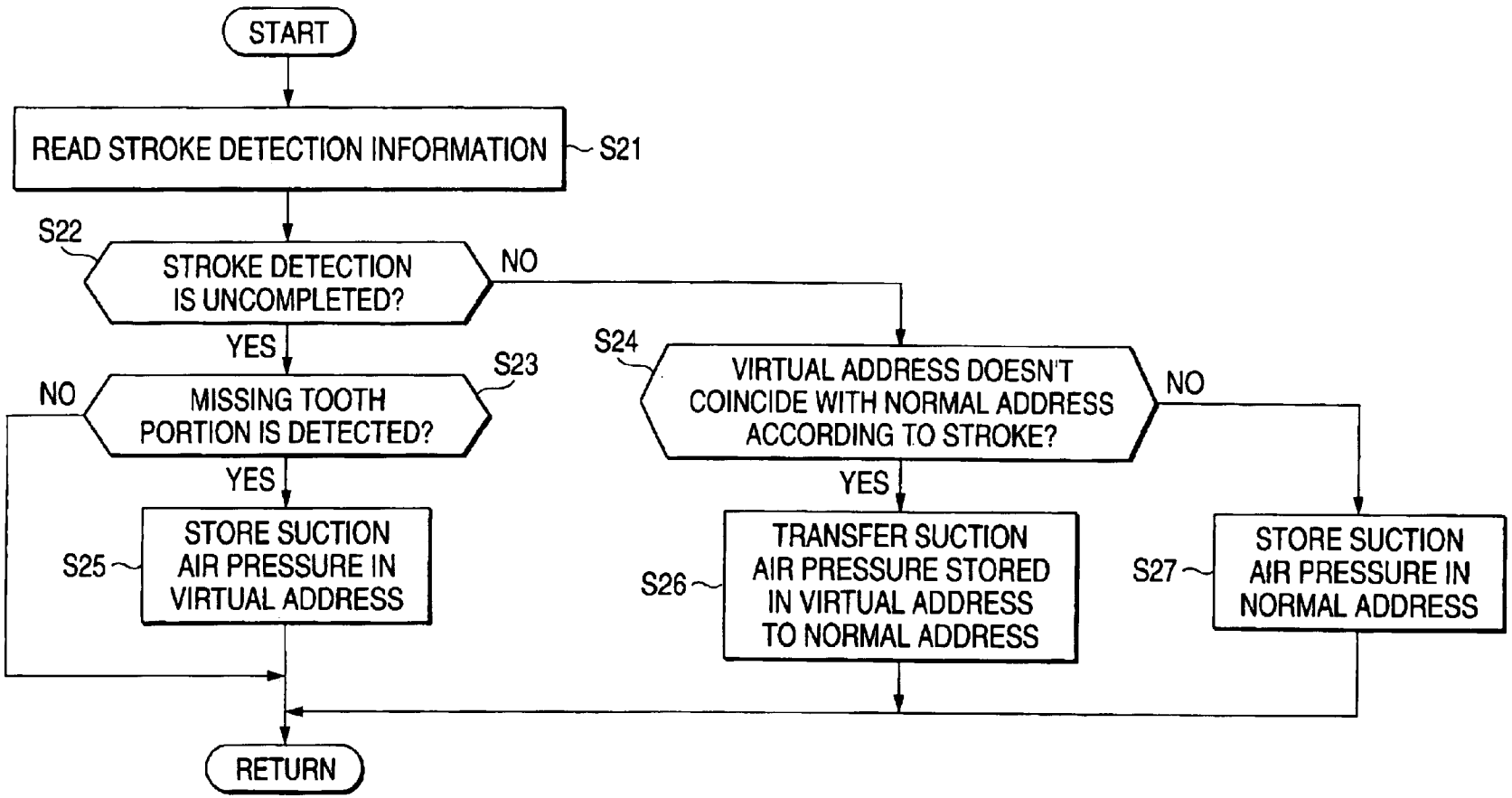
FIG. 6 is a flowchart showing an operation process that is performed in a suction air pressure storing section of FIG. 3.

The suction air pressure storing section 37 stores, through an operation process as shown in FIG. 6, the suction air pressure detected at that time in the address (memory area) "P0, P1, P2, . . . " corresponding to the sign "0, 1, 2, . . . " of the crank pulse as shown in FIG. 4.

The operation process of FIG. 6 is executed by the timer interrupt at every sampling time ΔT, equivalently to the operation process of FIG. 3. In this flowchart, though the steps for communication are not particularly provided, the information obtained through the operation process is stored and updated in the storage device at any time, and the information or program necessary for the operation process is read from the storage device at any time. Also, the address is assigned for one cycle of the stroke, or two rotations of the crankshaft 2, and the previous suction air pressures are deleted.

In this operation process, first of all, at step S21, the stroke detection information output from the stroke detection permitting section 39 is read in.

At step S22, a determination is made whether or not the stroke detection by the crank timing detecting section 27 is uncompleted. If the stroke detection is uncompleted, the procedure goes to step S23, or otherwise, transfers to step S24.

At step S23, a determination is made whether or not the crank pulse corresponding to the missing tooth portion is already detected among the crank pulses. If the missing tooth portion is already detected, the procedure goes to step S25, or otherwise, returns to the main program.

At step S25, the suction air pressure is stored in the virtual address when the stroke detection is uncompleted, and then the procedure returns to the main program, On the other hand, at step S24, a determination is made whether or not the virtual address coincides with the normal address corresponding to the detected stroke. If the virtual address does not coincide with the normal address corresponding to the stroke, the procedure goes to step S26, or otherwise, transfers to step S27.

At step S27, the suction air pressure is stored in the normal address corresponding to the detected stroke, and the procedure returns to the main program.

On the contrary, at step S26, the suction air pressure stored in the virtual address is transferred to the normal address corresponding to the stroke, and the procedure returns to the main program.

Figure 7:
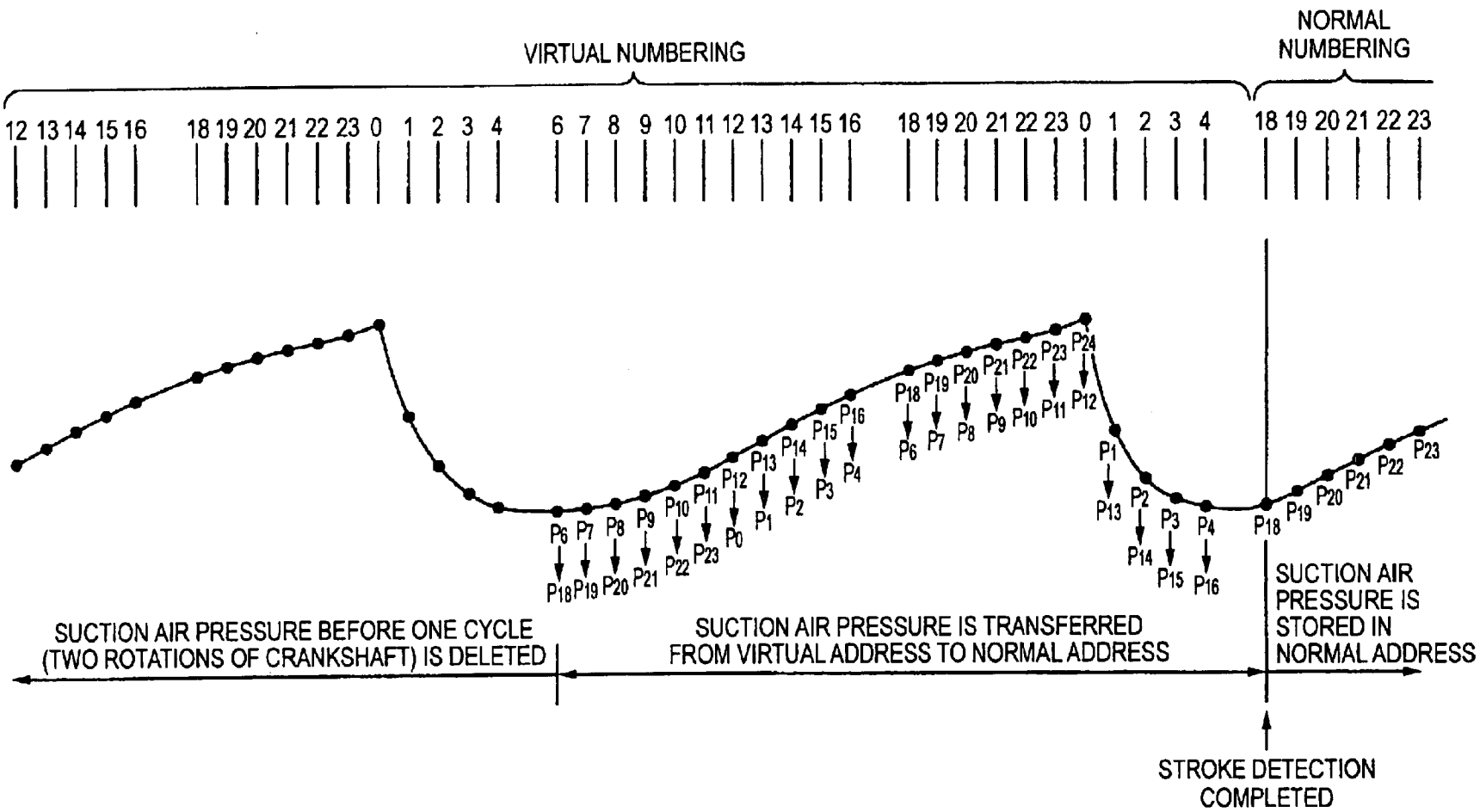
FIG. 7 is an explanatory view for explaining the action in the operation process of FIG. 6.

Through this operation process, the detected suction air pressure is stored in the virtual address in a period up to the stroke detection, but during the stroke detection, when the virtual address does not coincide with the normal address corresponding to the stroke, the suction air pressure stored in the virtual address is transfers to the normal address for suction air pressure, and thereafter the suction air pressure is stored in the normal address, as shown in FIG. 7. Accordingly, when the stroke detection is made, it is possible to compare the suction air pressure of the previous cycle with the present suction air pressure promptly.

Figure 8:
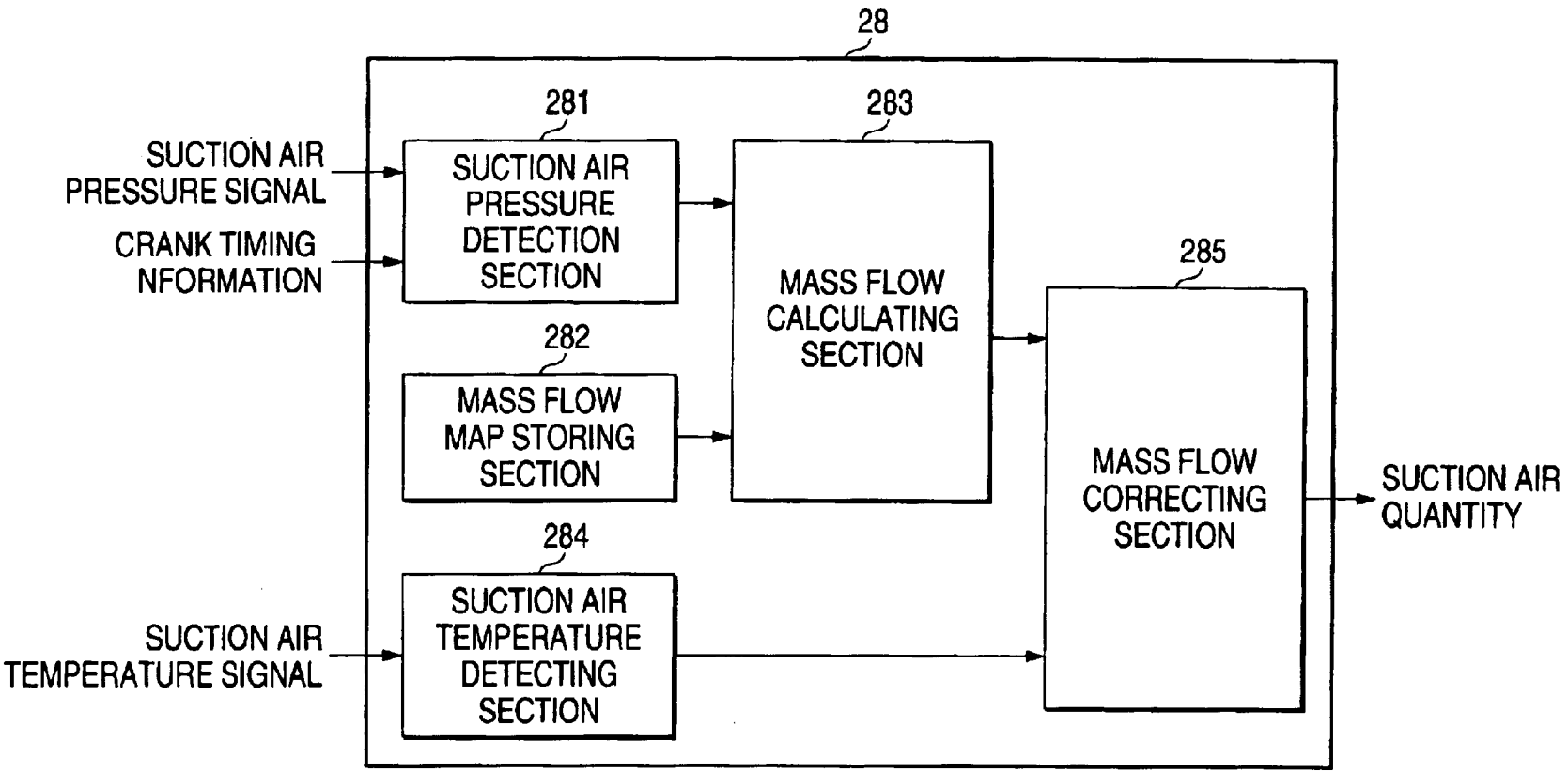
FIG. 8 is a block diagram of a suction air quantity calculating section.

The suction air quantity calculating section 28 comprises a suction air pressure detecting section 281 for detecting the suction air pressure from the suction air pressure signal and the crank timing information, a mass flow map storing section 282 for storing a map for use to detect the mass flow of suction air from the suction air pressure, a mass flow calculating section 283 for calculating the mass flow corresponding to the suction air pressure detected employing the mass flow map, a suction air temperature detecting section 284 for detecting the suction air temperature from the suction air temperature signal, and a mass flow correcting section 285 for correcting the mass flow of suction air from the mass flow of suction air calculated by the mass flow calculating section 283 and the suction air temperature detected by the suction air temperature detecting section 284, as shown in FIG. 8. That is, the suction air quantity is calculated by correcting the mass flow at the actual suction air temperature (in terms of the absolute temperature), because the mass flow map is produced with the mass flow at a suction air temperature of 20° C., for example.

In this embodiment, the suction air quantity is calculated, employing the suction air pressure value in the period from the bottom dead center in the compression stroke to the timing of closing the suction air valve. That is, when the suction air valve is released, the suction air pressure and an in-cylinder pressure are almost equivalent, whereby if the suction air pressure, a cubic capacity and the suction air temperature are known, an in-cylinder air mass is obtained. However, since the suction air valve is open for a while after the compression stroke starts, the air goes into or out of the in-cylinder and the suction pipe for this period, whereby there is a possibility that the suction air quantity obtained from the suction air pressure before the bottom dead center is actually different from the air quantity sucked into the cylinder. Therefore, when the same suction air valve is released, the suction air quantity is calculated, employing the suction air pressure in the compression stroke in which no air goes into or out of the in-cylinder and the suction pipe. More strictly, in consideration of the influence of a partial pressure of burnt gas, and employing the engine speed that is highly correlated with it, the suction air quantity may be corrected according to the engine speed obtained by the experiment.

Figure 9:
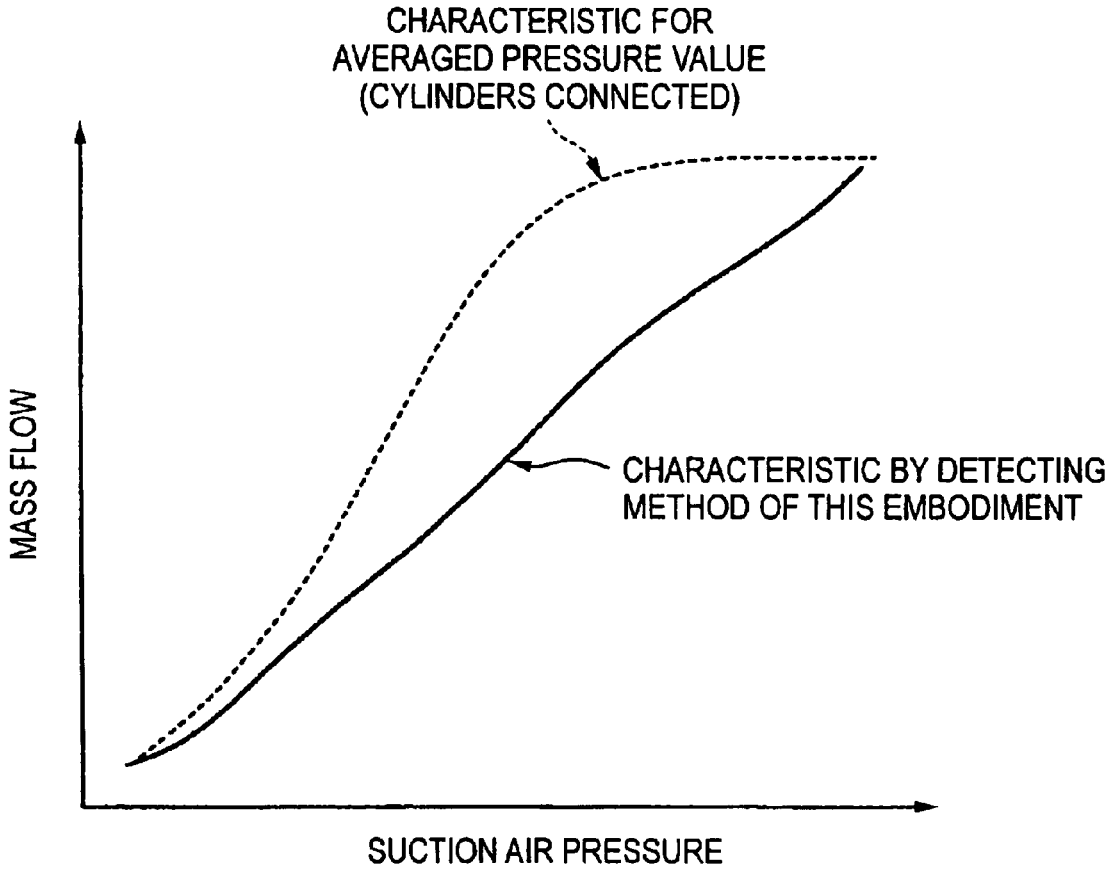
FIG. 9 is a control map for acquiring the mass flow of suction air from the suction air pressure.

Also, in this embodiment of the individual-suction system, the mass flow map for calculating the suction air quantity has a relatively linear relation with the suction air pressure, as shown in FIG. 9. This is because the obtained air mass is based on the Boyle-Charles' law (PV=nRT). On the contrary, when the suction pipe is connected in all the cylinders, it is not presumed that the suction air pressure is almost equal to the in-cylinder pressure under the influence of the pressures of other cylinders, whereby the map as indicated by the broken line in FIG. 9 must be employed.

The fuel injection quantity setting section 29 comprises a normal operation target air-fuel ratio calculating section 33 for calculating the normal operation target air-fuel ratio on the basis of the engine speed calculated by the engine speed calculating section 26 and the suction air pressure signal, a normal operation fuel injection quantity calculating section 34 for calculating the normal operation target air-fuel ratio calculated by the normal operation target air-fuel ratio calculating section 33 and the suction air quantity calculated by the suction air quantity calculating section 28, a fuel behavior model 35 for use to calculate the normal operation fuel injection quantity and the fuel injection timing in the normal operation fuel injection quantity calculating section 34, accelerated state detecting means 41 for detecting the accelerated state on the basis of the crank angle signal, the suction air signal and the crank timing information detected by the crank timing detecting section 27, and an acceleration fuel injection quantity calculating section 42 for calculating the acceleration fuel injection quantity and the fuel injection timing according to the engine speed calculated by the engine speed calculating section 26, as shown in FIG. 3. The fuel behavior model 35 is substantially integrated with the normal operation fuel injection quantity calculating section 34. That is, if there is no fuel behavior model 35, it is not possible to correctly calculate and set the fuel injection quantity and the fuel injection timing in this embodiment in which fuel is injected into suction pipe. The fuel behavior model 35 needs the suction air temperature, the engine speed and the cooling water temperature signal.

The normal operation fuel injection quantity calculating section 34 and the fuel behavior model 35 are configured as shown in a block diagram of FIG. 10. Herein, assuming that the fuel injection quantity injected from the injector 13 into the suction pipe 6 is $M_{F\text{-}INJ}$, and the fuel sticking ratio of fuel sticking onto the wall of the suction pipe 6 is X, among the fuel injection quantity $M_{F\text{-}INJ}$, the direct inflow quantity directly injected into the cylinder is $((1-X)\times M_{F\text{-}INJ})$, and the sticking quantity of fuel sticking onto the wall of the suction pipe is $(X\times M_{F\text{-}INJ})$. Some of the sticking fuel flows along the wall of the suction pipe into the cylinder. Assuming that its residual quantity is the fuel residual quantity $M_{F\text{-}SUF}$, and the take-off ratio of fuel to be taken off in the suction air flow among the fuel residual quantity $M_{F\text{-}SUF}$ is $\tau$, the in-flow quantity taken off into the cylinder is $(\tau\times M_{F\text{-}SUF})$.

Thus, the normal operation fuel injection quantity calculating section 34 firstly calculates a cooling water temperature correction factor $K_W$ from the cooling water temperature $T_W$, employing a cooling water temperature correction factor table. On the other hand, the suction air quantity $M_{A\text{-}MAN}$ is passed through a fuel cutting routine for cutting the fuel when the throttle opening is zero, and then the air inflow quantity $M_A$ corrected for temperature is calculated, employing the suction air temperature $T_A$, multiplied by a reciprocal ratio of the target air-fuel ratio $A_{F0}$, and further multiplied by the cooling water temperature correction factor $K_W$ to calculate a demanded fuel inflow quantity $M_F$. On the contrary, the fuel sticking ratio X is obtained from the engine speed $N_E$ and the suction pipe inner pressure $P_{A\text{-}MAN}$, employing a fuel sticking ratio map, and the take-off ratio $\tau$ is calculated from the engine speed $N_E$ and the suction pipe inner pressure $P_{A\text{-}MAN}$, employing the take-off ratio map. And the fuel residual quantity $M_{F\text{-}BUF}$ obtained at the previous operation is multiplied by the take-off ratio $\tau$ to calculate the fuel take-off quantity $M_{F\text{-}TA}$, which is then subtracted from the demanded fuel inflow quantity $M_F$ to calculate the fuel direct inflow quantity $M_{F\text{-}DIR}$. As previously described, the fuel direct inflow quantity $M_{F\text{-}DIR}$ is (1−X) times the fuel injection quantity $M_{F\text{-}INJ}$, and divided by (1−X) to calculate the normal operation fuel injection quantity $M_{F\text{-}INJ}$. Also, the fuel quantity $((1-\tau)\times M_{F\text{-}BUF})$ remains this time in the suction pipe among the fuel residual quantity $M_{F\text{-}BUF}$ remaining in the suction pipe up to the previous time, and is added to the fuel sticking quantity $(X\times M_{F\text{-}INJ})$ to calculate the present fuel residual quantity $M_{F\text{-}BUF}$.

Since the suction air quantity calculated by the suction air quantity calculating section 28 is detected at the final stage of the suction stroke one cycle before the suction stroke to be about to enter the explosion (expansion) stroke, or at the early stage of the subsequent compression stroke, the normal operation fuel injection quantity and the fuel injection timing calculated and set by the normal operation-fuel injection quantity calculating section 34 are resulted from the stroke one cycle before according to the suction air quantity.

Also, the accelerated state detecting section 41 has an accelerated state threshold table. This table contains a threshold value for detecting the accelerated state in which a difference value between the suction air pressure in the same stroke and at the same crank angle as at present and the present suction air pressure is calculated from the suction air pressure signal, and compared with a predetermined value, as will be described later. Specifically, the threshold value differs at each crank angle. Accordingly, the accelerated state is detected by comparing the difference value of the suction air pressure from the previous time with the predetermined value differing at each crank angle.

Figure 11:
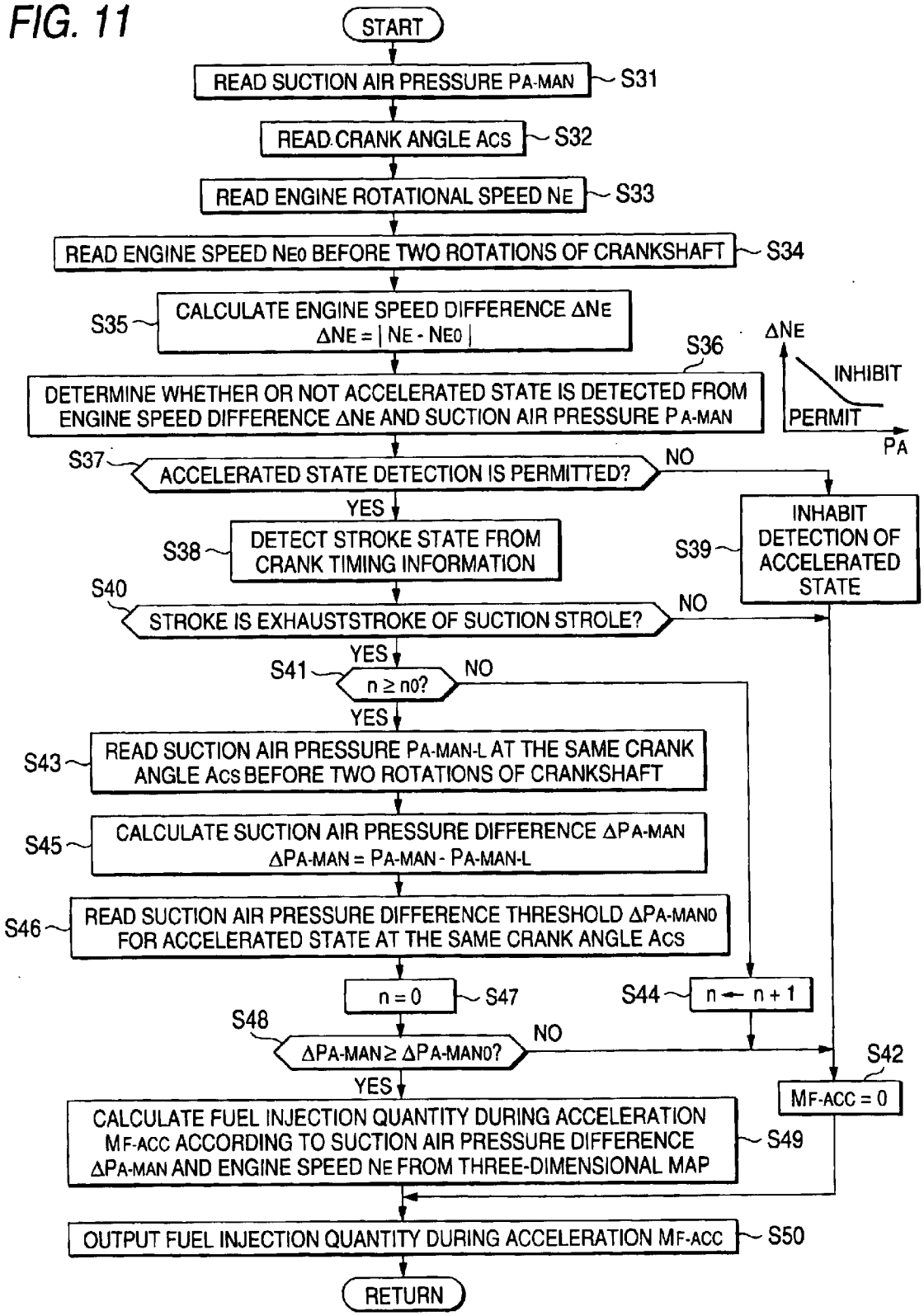
FIG. 11 is a flowchart showing an operation process for detecting the accelerated state and calculating the fuel injection quantity during acceleration.

The accelerated state detecting section 41 and the acceleration fuel injection quantity calculating section 42 are collectively performed substantially through the operation process of FIG. 11. This operation process is performed every time the crank pulse is entered. In this operation process, though no steps for communication are specifically provided, the information obtained by the operation process is stored in the storage device at any time, and the information required for the operation process is read from the storage device at any time.

In this operation process, first of all, at step S31, the suction air pressure $P_{A\text{-}MAN}$ is read from the suction air pressure signal.

At step S32, the crank angle $A_{CS}$ is read from the crank angle signal.

At step S33, the engine speed $N_E$ is read from the engine speed calculating section 26.

At step S34, the engine speed $N_{E0}$ prior to two rotations of the crankshaft, namely, at the stroke one cycle before, is read.

At step S35, the engine speed difference $\Delta N_E$ is calculated by taking an absolute value of the present engine speed $N_E$ read at step S33 subtracted by the engine speed $N_{E0}$ before two rotations of the crankshaft.

Figure 12:
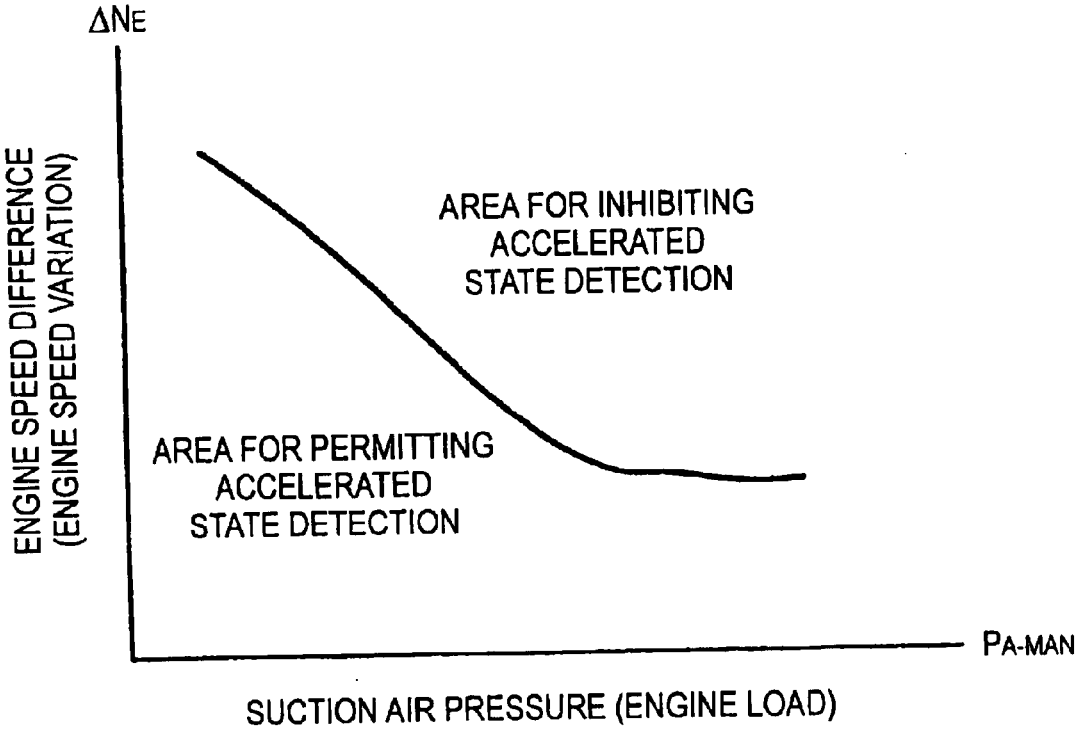
FIG. 12 is a timing chart showing the action in the operation process of FIG. 11.

Then, at step S36, a determination is made whether or not the accelerated state is detected from the engine speed difference $\Delta N_E$ calculated at step S35 and the suction air pressure $P_{A\text{-}MAN}$ read at step S31 in accordance with a control map of FIG. 12. In this control map of FIG. 12, the suction air pressure $P_{A\text{-}MAN}$ or the engine load is taken along the transverse axis, and the engine speed difference $\Delta N_E$ or the engine speed variation is taken along the longitudinal axis. This control map has the area segmented by a curve being convex on the lower side and decreasing to the right lower side. An accelerated state detection inhibiting area is defined as the area where the suction air pressure $P_{A\text{-}MAN}$ or engine speed difference $\Delta N_E$ is large, and an accelerated state detection permitting area is defined as the area where the suction air pressure $P_{A\text{-}MAN}$ or engine speed difference $\Delta N_E$ is small. The details of this control map will be described later.

Then, at step S37, a determination is made whether or not the accelerated state detection is permitted on the basis of the result of detecting the accelerated state at step S36. If the accelerated state detection is permitted, the procedure goes to step S38, or otherwise, transfers to step S39.

At step S38, the stroke state is detected from the crank timing information output from the crank timing detecting section 27, and then the procedure goes to step S40.

At step S40, a determination is made whether or not the present stroke is the exhaust or suction stroke. If the present stroke is the exhaust or suction stroke, the procedure goes to step S41, or otherwise, transfers to step S42.

At step S41, a determination is made whether or not an acceleration fuel injection inhibiting counter n is greater than or equal to a predetermined value $n_0$ at which the acceleration fuel injection is permitted. If the acceleration fuel injection inhibiting counter n is greater than or equal to the predetermined value $n_0$, the procedure goes to step S43, or otherwise, transfers to step S44.

At step S43, the suction air pressure at the same crank angle $A_{CS}$ before two rotations of the crankshaft, namely, in the same stroke at the previous cycle (hereinafter referred to as a previous suction air pressure value) PA-MAN-L is read in, and the procedure goes to step S45.

At step S45, the suction air pressure difference $\Delta P_{A\text{-}MAN}$ is calculated by subtracting the previous suction air pressure value $P_{A\text{-}MAN\text{-}L}$ from the present suction air pressure value $P_{A\text{-}MAN}$ read at step S31, and then the procedure goes to step S46.

At step S46, an accelerated state suction air pressure difference threshold value $\Delta P_{A\text{-}MAN0}$ at the same crank angle $A_{CS}$ is read from the accelerated state threshold table, and then the procedure goes to step S47.

At step S47, the acceleration fuel injection inhibiting counter n is cleared, and then the procedure goes to step S48.

At step S48, a determination is made whether or not the suction air pressure difference $\Delta P_{A\text{-}MAN}$ calculated at step S45 is greater than or equal to the accelerated state suction air pressure difference threshold value $\Delta P_{A\text{-}MAN0}$ at the same crank angle $A_{CS}$ that is read at step S46. If the suction air pressure difference $\Delta P_{A\text{-}MAN}$ is greater than or equal to the accelerated state suction air pressure difference threshold value $\Delta P_{A\text{-}MAN0}$, the procedure goes to step S49, or otherwise, transfers to step S42.

On the other hand, at step S44, the acceleration fuel injection inhibiting counter n is incremented, and then the procedure transfers to step S42.

Also, at step S39, the accelerated state detection is inhibited, and then the procedure transfers to step S42.

At step S49, the acceleration fuel injection quantity $M_{F\text{-}ACC}$ is calculated on the basis of the suction air pressure difference $\Delta P_{A\text{-}MAN}$ calculated at step S45 and the engine speed $N_E$ read at step S33, employing a three-dimensional map, and then the procedure transfers to step S50.

Also, at step S42, the acceleration fuel injection quantity $M_{F\text{-}ACC}$ is set to "0", and then the procedure transfers to step S50.

At step S50, the acceleration fuel injection quantity $M_{F\text{-}ACC}$ set at step S49 or S50 is output, and then the procedure returns to the main program.

In this embodiment, the acceleration fuel injection timing takes place when the accelerated state is detected by the accelerated state detecting section 41. That is, the fuel is injected rapidly when the suction air pressure difference $\Delta P_{A\text{-}MAN}$ is greater than or equal to the accelerated state suction air pressure difference threshold value $\Delta P_{A\text{-}MAN0}$ at step S48 in the operation process of FIG. 11. In other words, the acceleration fuel is injected when the accelerated state is determined.

Also, the ignition timing setting section 31 comprises a basic ignition timing calculating section 36 for calculating the basic ignition timing on the basis of the engine speed calculated by the engine speed calculating section 26 and the target air-fuel ratio calculated by the target air-fuel ratio calculating section 33, and an ignition timing correcting section 38 for correcting the basic ignition timing calculated by the basic ignition timing calculating section 36 on the basis of the acceleration fuel ignition quantity calculated by the acceleration fuel injection quantity calculating section 42.

The basic ignition timing calculating section 36 calculates the basic ignition timing by retrieving from the map the ignition timing at which the largest torque is produced at the present engine speed and the target air-fuel ratio at that time. That is, the basic ignition timing calculated by this basic ignition timing calculating section 36 is based on the result of the suction stroke one cycle before in the same manner as the normal operation fuel ignition quantity calculating section 34. Also, the ignition timing correcting section 38 corrects the ignition timing by acquiring the in-cylinder air-fuel ratio when the acceleration fuel injection quantity calculated by the acceleration fuel injection quantity calculating section 42 is added to the normal operation fuel injection quantity, and setting the new ignition timing, employing the in-cylinder air-fuel ratio, the engine speed and the suction air pressure, when the in-cylinder air-fuel ratio is greatly different from the target air-fuel ratio set by the normal operation target air-fuel ratio calculating section 33.

Figure 13:
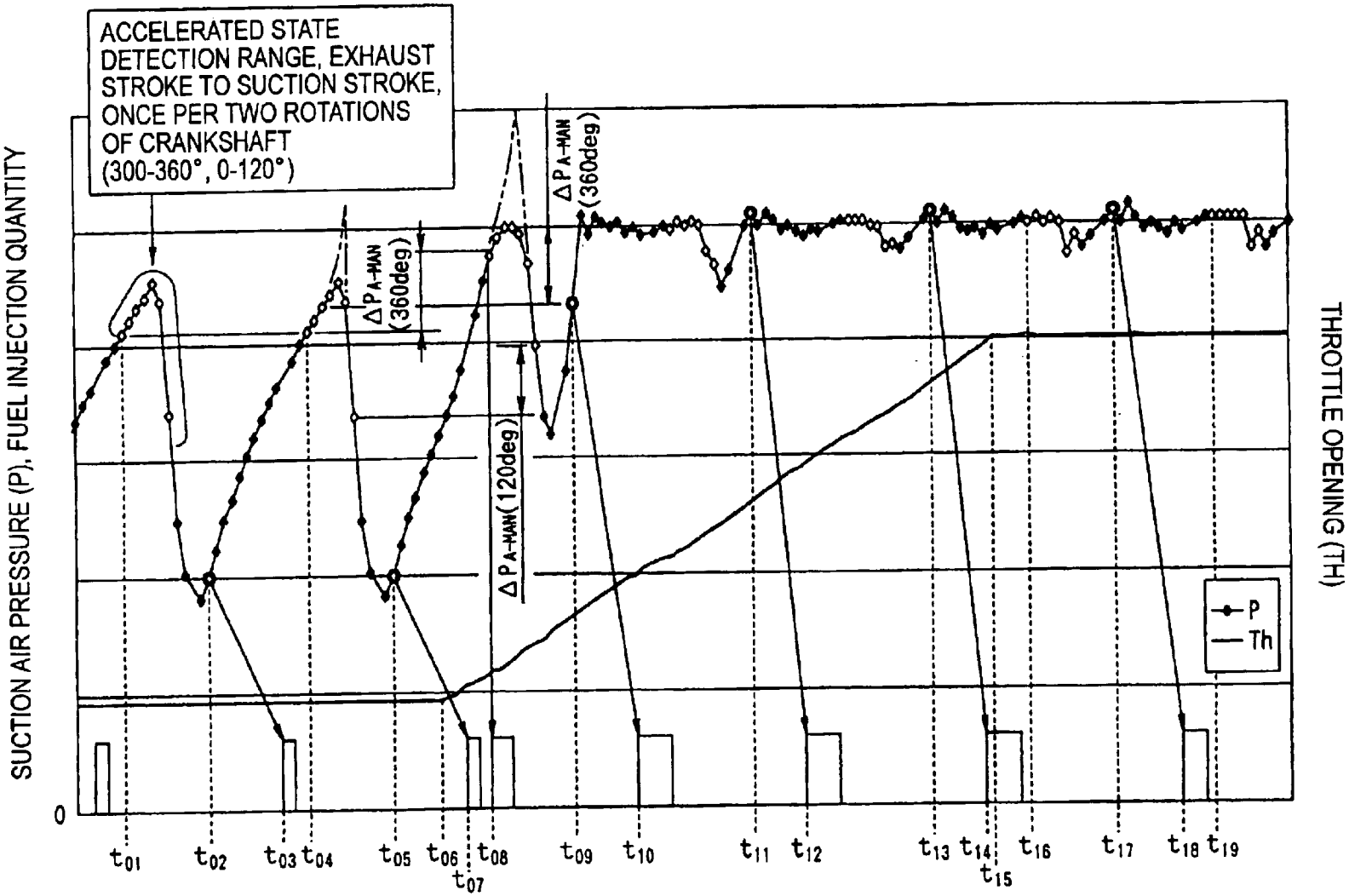
FIG. 13 is an explanatory view for explaining the suction air pressure when there are great variations in the engine speed.

The action of the operation process of FIG. 11, when the accelerated state detection is not inhibited, will be described below with reference to a timing chart of FIG. 13. In this timing chart, the throttle opening is invariant till time $t_{06}$, linearly opened in a relatively short period from the time $t_{06}$ to time $t_{15}$, and then becomes invariant again. In this embodiment, the suction air valve is set to be released from slightly before the exhaust top dead center to slightly after the compression bottom dead center. In FIG. 13, a curve with lozenge plot represents the suction air pressure, and a pulse waveform on the bottom portion represents the fuel injection quantity. As previously described, the stroke where the suction air pressure sharply decreases is the suction stroke. The suction stroke, the compression stroke, the expansion (explosion) stroke, and the exhaust stroke are repeated as the cycle.

This suction air pressure curve with lozenge plot indicates the crank pulse at every 30°, in which the target air-fuel ratio is set according to the engine speed at the crank angle position (240°) encircled by o and the normal operation fuel injection quantity and the fuel injection timing are set up, employing the suction air pressure detected at that time. In this timing chart, the fuel of the normal operation fuel injection quantity set at time $t_{02}$ is injected at time $t_{03}$. In the same manner, the normal operation fuel injection quantity is set at time $t_{05}$ and injected at time $t_{07}$, set at time $t_{09}$ and injected at time $t_{10}$, set at time $t_{11}$ and injected at time $t_{12}$, set at time $t_{13}$ and injected at time $t_{14}$, and set at time $t_{17}$ and injected at time $t_{18}$. Among others, the normal operation fuel injection quantity set at time $t_{09}$ and injected at time $t_{10}$ is set to be higher than the previous normal operation fuel injection quantities, because the suction air pressure is already so high that the large suction air quantity is calculated. However, since the normal operation fuel injection quantity is set in the compression stroke, and the normal operation fuel injection timing takes place in the exhaust stroke, the driver's will of acceleration at that time may not be reflected in real time to the normal operation fuel injection quantity. That is, since the throttle is opened at time $t_{06}$, but the normal operation fuel injection quantity injected at time $t_{07}$ is set at time $t_{05}$ earlier than time $t_{06}$, a small quantity of fuel is only injected against the driver's will of acceleration.

On the other hand, in this embodiment, the suction pressure $P_{A\text{-}MAN}$ at the crank angle with void lozenge as indicated in FIG. 13 is compared with that at the same crank angle in the previous cycle, its difference value being calculated as the suction air pressure difference $\Delta P_{A\text{-}MAN}$ and compared with a threshold value $\Delta P_{A\text{-}MAN0}$ through the operation process of FIG. 11 from the exhaust process to the suction process. For example, if the suction air pressure $P_{A\text{-}MAN(300deg)}$ of the crank angle 300° are compared between time $t_{01}$ and time $t_{04}$, or between time $t_{16}$ and time $t_{19}$ when the throttle opening is fixed, they are almost equivalent with the difference value from the previous value, namely, the suction air pressure difference $\Delta P_{A\text{-}MAN}$ being small. However, the suction air pressure $P_{A\text{-}MAN(300deg)}$ of the crank angle 300° at time $t_{08}$ when the throttle opening is increased is higher than the suction air pressure $P_{A\text{-}MAN(300deg)}$ of the crank angle 300° at time $t_{04}$ when the throttle opening is small at the previous cycle. Accordingly, the suction air pressure difference $\Delta P_{A\text{-}MAN(300deg)}$ that is obtained by subtracting the suction air pressure $P_{A\text{-}MAN(300deg)}$ of the crank angle 300° at time $t_{04}$ from the suction air pressure $P_{A\text{-}MAN(300deg)}$ of the crank angle 300° at time $t_{08}$ is compared with a threshold value $\Delta P_{A\text{-}MAN0(300deg)}$ and if the suction air pressure difference $\Delta P_{A\text{-}MAN(300deg)}$ is larger than the threshold value $\Delta P_{A\text{-}MAN0(300deg)}$, the accelerated state is determined.

In this connection, the accelerated state detection by the suction air pressure difference $\Delta P_{A\text{-}MAN}$ is noticeable in the suction stroke. For example, the suction air pressure difference $\Delta P_{A\text{-}MAN(120deg)}$ of the crank angle 120° in the suction stroke is likely to appear clearly. However, the suction air pressure curve indicates a sharp, so-called peaky property, depending on the characteristics of the engine, as indicated by the two-dot chain line in FIG. 13, in which there is a fear of deviating the calculated suction air pressure difference. Therefore, the detection range of the accelerated state is extended to the exhaust stroke where the suction air pressure curve is relatively smooth, whereby the accelerated state detection is made with the suction air pressure difference in both the strokes. Of course, the accelerated state detection may be made in only one of the strokes depending on the characteristics of the engine.

In the four-stroke cycle engine as in this embodiment, the exhaust stroke and the suction stroke are performed once for every two rotations of the crankshaft. Accordingly, even if the crank angle alone is detected, the stroke is not determined in the two-wheeled vehicle without the came sensor as in this embodiment. Thus, after the stroke state based on the crank timing information detected by the crank timing detecting section 27 is read, and the stroke is determined, the accelerated state detection is made based on the suction air pressure difference $\Delta P_{A\text{-}MAN}$. Thereby, the accelerated state detection is allowed more accurately.

As will be apparent from the comparison with the suction air pressure difference $\Delta P_{A\text{-}MAN(360deg)}$ of the crank angle 360° as shown in FIG. 13, but not the suction air pressure difference $\Delta P_{A\text{-}MAN(300deg)}$ of the crank angle 300° and the suction air pressure difference $\Delta P_{A\text{-}MAN(120deg)}$ of the crank angle 120°, the suction air pressure difference $\Delta P_{A\text{-}MAN}$ that is a difference value from the previous value differs at each crank angle even in the equivalent throttle open state. Accordingly, the accelerated state suction air pressure difference threshold value $\Delta P_{A\text{-}MAN0}$ must be changed for every crank angle $A_{CS}$. Thus, in this embodiment, to detect the accelerated state, the accelerated state suction air pressure difference threshold value $\Delta P_{A\text{-}MAN0}$ for each crank angle $A_{CS}$ is stored in a table, and read for each crank angle $A_{CS}$ from the table for comparison with the suction air pressure difference. $\Delta P_{A\text{-}MAN}$. Thereby, the accelerated state detection is allowed more accurately.

And in this embodiment, the acceleration fuel injection quantity $M_{F\text{-}ACC}$ according to the engine speed $N_E$ and the suction air pressure difference $\Delta P_{A\text{-}MAN}$ is injected promptly at time $t_{08}$ when the accelerated state is detected. It is quite common that the acceleration fuel injection quantity $M_{F\text{-}ACC}$ is set according to the engine speed $N_E$, although the fuel injection quantity is normally set to be smaller for the higher engine speed. Since the suction air pressure difference $\Delta P_{A\text{-}MAN}$ is equivalent to the variation in the throttle opening, the fuel injection quantity is set to be larger for the larger suction air pressure difference. Substantially, even if the fuel injection quantity is injected, the suction air pressure is already so high that in the subsequent suction stroke, more suction air quantity is to be sucked, whereby it does not occur that the air-fuel ratio in the cylinder is so small as to cause knocking. And since the acceleration fuel is inject promptly during accelerated state detection in this embodiment, the air-fuel ratio in the cylinder is controlled to be suited for the accelerated state to transfer to the explosion stroke, and the acceleration fuel injection quantity is set according to the engine speed and the suction air pressure difference, whereby the driver has a feeling of acceleration as intended.

Also, in this embodiment, though the accelerated state is detected and the acceleration fuel injection quantity is injected from the fuel injector, the acceleration fuel injection is not performed until the acceleration fuel injection inhibiting counter n is greater than the predetermined value $n_0$ permitting the acceleration fuel injection, even if the accelerated state is detected. Hence, the acceleration fuel injection is suppressed from being repeated to make the air-fuel ratio in the cylinder overrich.

Also, the expensive and large cam sensor is dispensed with by detecting the stroke state from the phase of the crankshaft. In this embodiment not employing the came sensor, it is important to detect the phase of the crankshaft and the stroke. However, in this embodiment in which the stroke is detected from the crank pulse and the suction air pressure, the stroke is not detected unless the crankshaft is rotated at least twice. However, it is unknown at which stroke the engine is stopped. That is, it is unknown from which stroke the cranking is started. Thus, in this embodiment, the fuel is injected at a predetermined crank angle for every rotation of the crankshaft from the cranking start to the stroke detection, and ignition is made near the compression top dead center for every rotation. Of the crankshaft.

Figure 14:
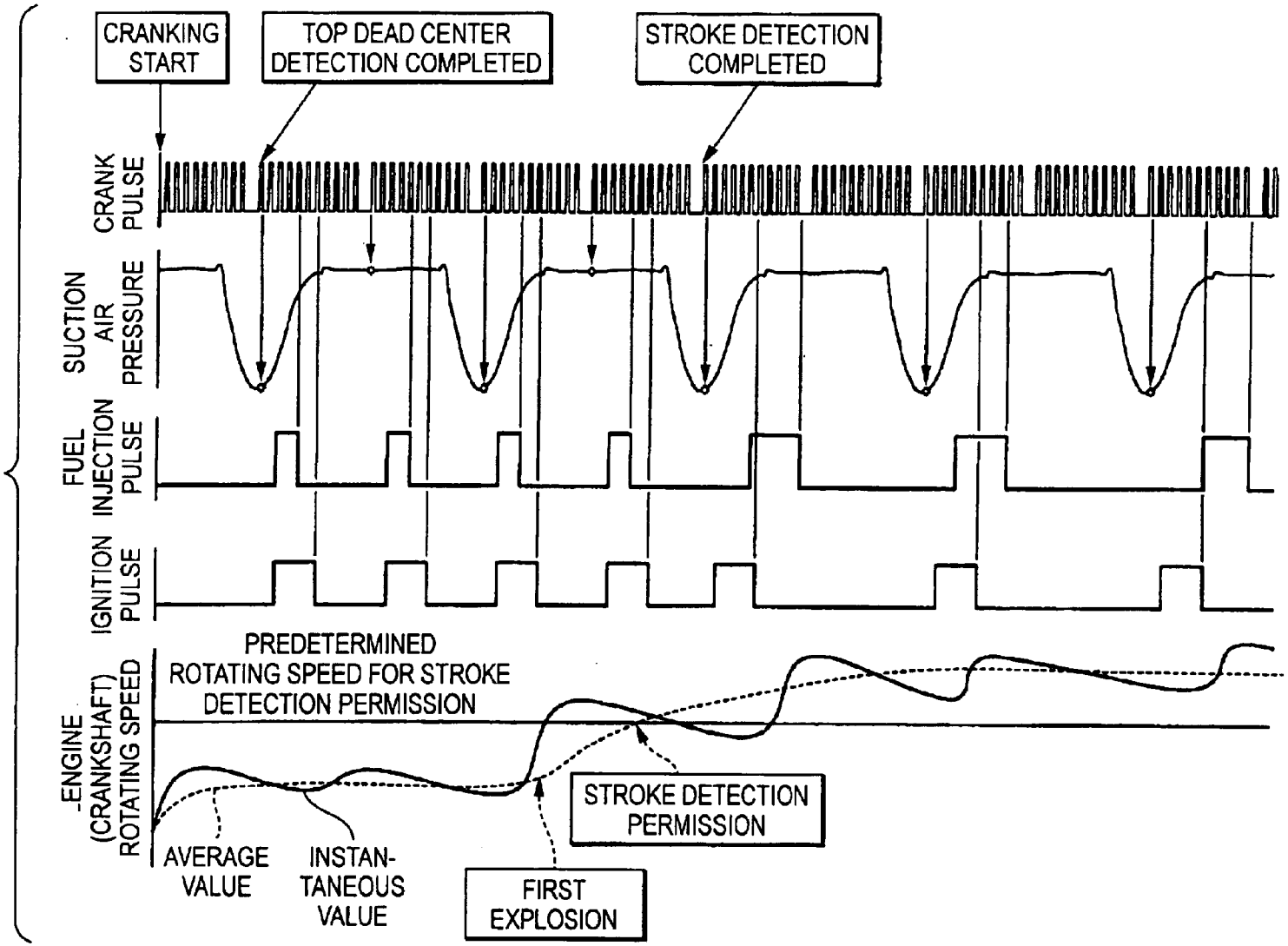
FIG. 14 is an explanatory view for explaining the suction air pressure when the engine load is high.

FIG. 14 shows the engine speed (rotational number of the crankshaft), the fuel injection pulse and the ignition pulse varying over the time when a first explosion is made under the control of the fuel injection and the ignition timing at the engine start, and thereafter the engine rotation is started. As previously described, until the first explosion is obtained and the average value of engine speed is greater than or equal to a predetermined rotational number for permitting the stroke detection, the ignition pulse is output at the fall time of the crank pulse "0" or "12" (numbering is not correct at this time) for every rotation of the crankshaft, and the fuel injection pulse is output at the fall time of the crank pulse "10" or "22" (numbering is not correct at this time) for every rotation of the crankshaft. In this connection, the ignition is made at the end or the fall time of the ignition pulse, and the fuel injection is ended at the end or the fall time of the fuel injection pulse.

Since the first explosion is obtained under the fuel injection and ignition control, the average value of engine speed is increased, and the stroke detection is permitted when the average value of engine speed exceeds the predetermined rotational number for permitting the stroke detection, whereby the stroke detection is made by comparison with the previous suction air pressure at the same crank angle, as previously described. After the stroke is detected, the fuel with the target air-fuel ratio is injected once per cycle at the ideal timing when not in the accelerated state. On the other hand, though the ignition timing occurs once per cycle after the stroke is detected, the cooling water temperature does not yet reach a predetermined temperature, so that the idle number of rotations is not stable, whereby the ignition pulse is output at the ignition timing that is at an advance angle of 10° prior to the compression top dead center, namely, at the rise time of crank pulse "0" in FIG. 3. Thereafter, the engine speed is rapidly increased.

In this embodiment, at the engine start, in a period up to stroke detection, the detected suction air pressure is stored in the virtual address, and during stroke detection, when the virtual address does not coincide with the normal address corresponding to the stroke, the suction air pressure stored in the virtual address is transferred to the normal address, and thereafter the suction air pressure is stored in the normal address. Accordingly, the accelerated state detection is made by comparing the suction air pressure at the previous cycle and the present suction air pressure immediately after the stroke is detected, so that the accelerated state detection is quickened correspondingly. This is especially effective for the two-wheeled vehicle of small displacement that is accelerated quickly after the engine is started.

Figure 15:
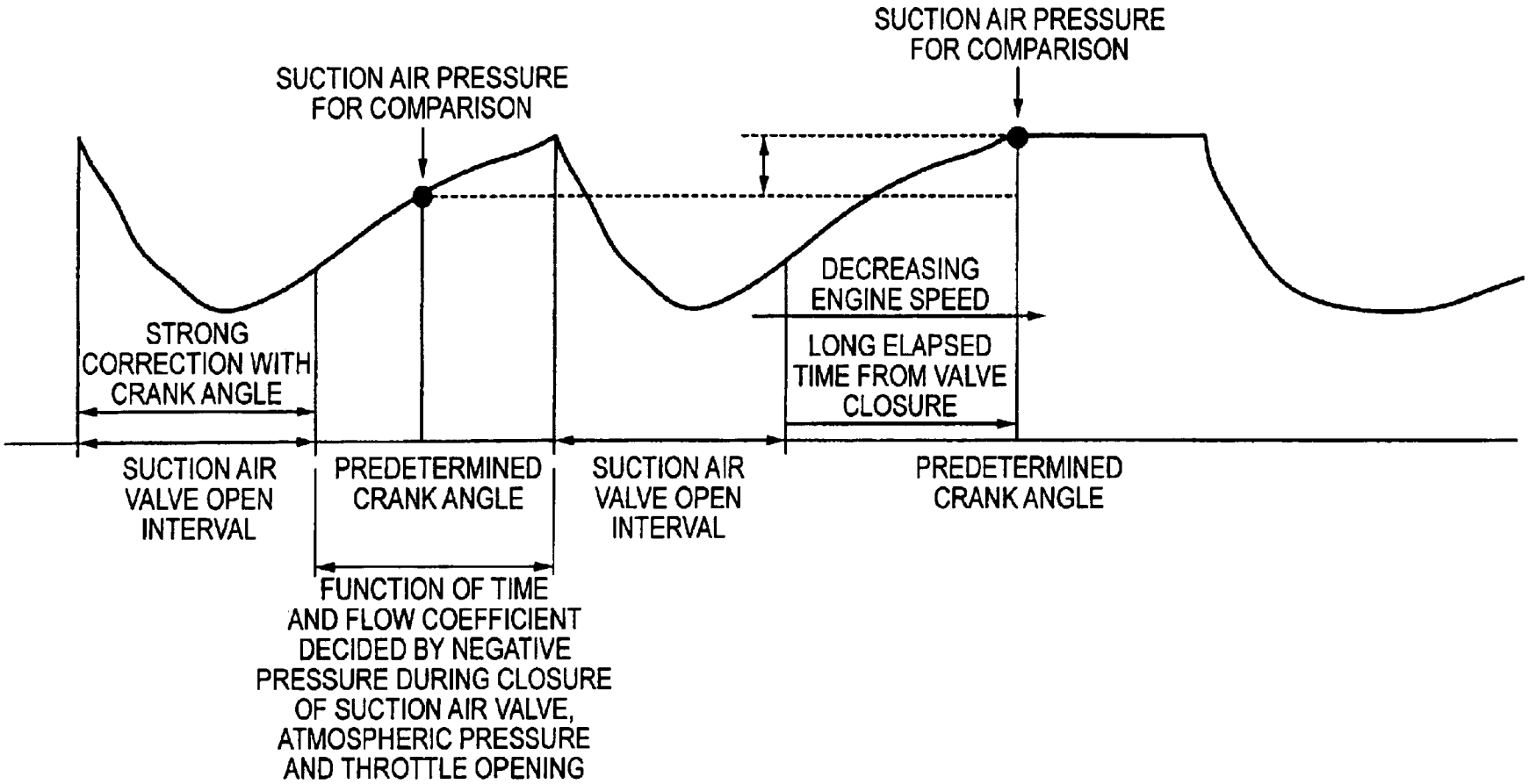
FIG. 15 is a graph showing the suction air pressure when the throttle valve is rapidly closed.

On the other hand, in this embodiment, when the engine speed difference, or the engine speed variation is high, or when the suction air, pressure is great, namely the engine load is high, the accelerated state detection is inhibited. FIG. 15 shows the suction air pressure when the throttle valve is rapidly closed. As previously described, the suction air pressure while the suction air valve is open is strongly correlated with the phase of the crankshaft. On the other hand, the suction air pressure variation is a function of time based on the flow coefficient decided by the negative pressure during the closure of the suction air valve, the atmospheric pressure, and the opening of the throttle valve, namely, the magnitude of the load in a period since the suction air valve is closed until the suction air valve is opened at the next time. Accordingly, the suction air pressure at a predetermined crank angle is increased from the time before the engine speed decreases to the time after the engine speed decreases, irrespective of the same crank angle, because the elapsed time since the closure of the suction air valve is greatly different, as shown in FIG. 15. Herein, since the throttle valve is closed, it is apparent that the engine is not in the accelerated state. However, if an increase in the suction air pressure is greater than or equal to a threshold value for accelerated state suction air pressure difference, there is a possibility that the accelerated state is falsely detected. Thus, when the engine speed variation is high, the detection of the accelerated state is inhibited in this embodiment.

Figure 16:
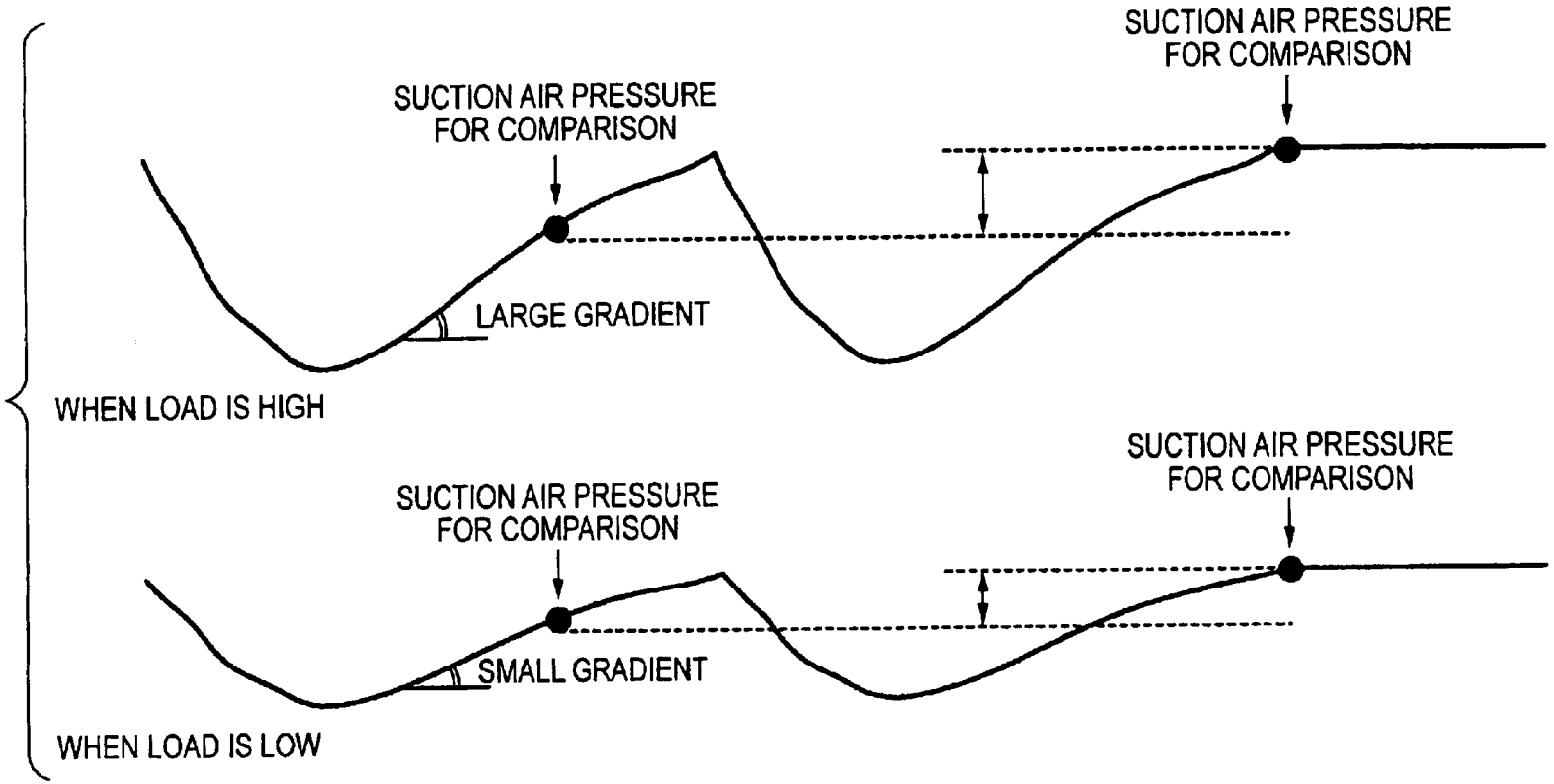
FIG. 16 is graphs showing the suction air pressures when the engine load is high and when the load is low.

The same thing is true with the magnitude of load. FIG. 16 shows the suction air pressures when the engine load is high and when the load is low. When the suction air valve is closed, the gradient in the increase of suction air pressure is larger with higher load, whereby there is a greater increase in the suction air pressure at the predetermined crank angle when the engine speed is changed. If this increase in the suction air pressure is greater than or equal to the threshold value for accelerated state suction air pressure difference, there is a possibility that the accelerated state is falsely detected. Thus, when the engine load is high, the detection of the accelerated state is inhibited in this embodiment.

Though a suction air pipe injection type engine is described in detail in this embodiment, the engine controller of this invention is also applicable to a direct injection engine.

Also, though the single cylinder engine is described in detail in this embodiment, the engine controller of this invention is also applicable to a so-called multi-cylinder engine having two or more cylinders.

Also, an engine control unit may be employed in various operation circuits, instead of a microcomputer.

Effect of the Invention

As described above, in an engine controller according to claim 1 of the present invention, the accelerated state is detected when a difference value between the previous suction air pressure and the present suction air pressure detected at the same stroke in the same crankshaft phase is greater than or equal to a predetermined value, an acceleration fuel injection quantity injected from the fuel injection equipment is set when the accelerated state is detected, detection of the accelerated state is inhibited depending on an operating condition of the engine. Accordingly, when the detection of the accelerated state is difficult, such as when the engine load is high, or when the engine speed variation is high, for example, a false detection of the accelerated state is avoided.

Also, in the engine controller according to claim 2 of the invention, when the engine load is high, the detection of the accelerated state is inhibited. Accordingly, a false detection of the accelerated state is avoided.

Also, in the engine controller according to claim 3 of the invention, when the engine speed variation is high, the detection of the accelerated state is inhibited. Accordingly, a false detection of the accelerated state is avoided.

Also, in an engine controller according to claim 4 of the invention, the engine stroke is detected on the basis of the detected phase of the crankshaft and the suction air pressure, an operating condition of the engine is controlled on the basis of the detected engine stroke, and the suction air pressure is stored in a virtual memory area corresponding to the phase of the crankshaft till the engine stroke is detected, and in a normal memory area after the engine stroke is detected, wherein during the detection of the engine stroke, if the virtual memory area corresponding to the phase of the crankshaft does not coincide with the normal memory area, the suction air pressure stored in the virtual memory area is transferred to the normal memory area. Therefore, it is possible to compare the suction air pressure one cycle before and the present suction air pressure immediately after the stroke is detected, whereby the detection of the accelerated state is further quickened.

What is claimed is:

1. An engine controller comprising:

phase detecting means for detecting the phase of a crankshaft in a four-stroke cycle engine;

suction air pressure detecting means for detecting a suction air pressure within a suction air passage of said engine;

accelerated state detecting means for detecting an accelerated state when a difference value between a previous suction air pressure and a present suction air pressure detected at the same stroke in the same crankshaft phase by said suction air pressure detecting means is greater than or equal to a predetermined value;

acceleration fuel injection quantity setting means for setting an acceleration fuel injection quantity injected from the fuel injection equipment when said accelerated state detecting means detects the accelerated state;

engine operating condition detecting means for detecting an operating condition of the engine; and accelerated state detection inhibiting means for inhibiting said accelerated state detecting means from detecting the accelerated state depending on the operating condition of the engine detected by said engine operating condition detecting means.

2. The engine controller according to claim 1, further comprising:

engine load detecting means for detecting an engine load as said engine operating condition detecting means, in which said accelerated state detection inhibiting means inhibits the detection of said accelerated state when the engine load detected by said engine load detecting means is high.

3. The engine controller according to claim 1 or 2, further comprising:

engine speed detecting means for detecting an engine speed as said engine operating condition detecting means, in which said accelerated state detection inhibiting means inhibits the detection of said accelerated state when there is a great variation in the engine speed detected by said engine speed detecting means.

4. An engine controller comprising:

crankshaft phase detecting means for detecting the phase of a crankshaft;

suction air pressure detecting means for detecting a suction air pressure within a suction air passage of an engine;

stroke detecting means for detecting an engine stroke on the basis of the phase of said crankshaft detected by said crankshaft phase detecting means and the suction air pressure detected by said suction air pressure detecting means;

engine control means for controlling an operating condition of the engine on the basis of the engine stroke detected by said stroke detecting means; and suction air pressure storing means for storing the suction air pressure detected by said suction air pressure detecting means in a memory area corresponding to the phase of said crankshaft detected by said crankshaft phase detecting means, wherein said suction air pressure storing means stores the suction air pressure detected by said suction air pressure detecting means in a virtual memory area corresponding to the phase of said crankshaft detected by said crankshaft phase detecting means, till the engine stroke is detected by said stroke detecting means, and stores the suction air pressure detected by said suction air pressure detecting means in a normal memory area corresponding to the phase of said crankshaft detected by said crankshaft phase detecting means, after the engine stroke is detected by said stroke detecting means, and when the engine stroke is detected by said stroke detecting means, if the virtual memory area corresponding to the phase of said crankshaft does not coincide with the normal memory area, the suction air pressure stored in said virtual memory area is transferred to said normal memory area.

* * * * *